US009637139B2

(12) United States Patent
Kathan et al.

(10) Patent No.: US 9,637,139 B2
(45) Date of Patent: May 2, 2017

(54) RIGID TENSIONING MEMBER AND TENSION MEASURING DEVICE FOR A TOWING SYSTEM FOR TOWING A USER ON A SUPPORT MATERIAL

(71) Applicant: Daniel Kathan, Vermette (CA)

(72) Inventors: Daniel Kathan, Vermette (CA); Alan Kathan, Vermette (CA)

(73) Assignee: Daniel Kathan, Vermette, Manitoba (CA)

( * ) Notice: Subject to any disclaimer, the term of this patent is extended or adjusted under 35 U.S.C. 154(b) by 0 days.

(21) Appl. No.: 15/013,001

(22) Filed: Feb. 2, 2016

(65) Prior Publication Data

US 2016/0332638 A1 Nov. 17, 2016

Related U.S. Application Data

(63) Continuation-in-part of application No. 14/710,155, filed on May 12, 2015.

(51) Int. Cl.

| | |
|---|---|
| ***B61B 12/00*** | (2006.01) |
| ***B61B 11/00*** | (2006.01) |
| ***A63C 11/10*** | (2006.01) |

(52) U.S. Cl.

CPC ..... *B61B 12/007* (2013.01); *A63C 11/10* (2013.01); *B61B 11/00* (2013.01)

(58) Field of Classification Search

CPC ..... B61B 11/00; B61B 12/007; A63C 11/10

See application file for complete search history.

(56) References Cited

U.S. PATENT DOCUMENTS

| | | | | |
|---|---|---|---|---|
| 2,087,232 A * | 7/1937 | Constam | B61B 12/02 | 104/173.2 |
| 2,181,519 A * | 11/1939 | Paquette | B61B 11/00 | 104/178 |
| 2,582,201 A * | 1/1952 | Huntington | B61B 11/00 | 104/173.2 |
| 2,677,331 A * | 5/1954 | Hauseman | B61B 11/00 | 104/112 |

(Continued)

FOREIGN PATENT DOCUMENTS

WO 2009015878 2/2009

*Primary Examiner* — Jason C Smith

(74) *Attorney, Agent, or Firm* — Adrian D. Battison; Ryan W. Dupuis; Ade & Company Inc.

(57) ABSTRACT

A towing system comprises towers arranged relative to a skiing surface; a pulley on each tower; and a motor effecting rotation of at least one pulley. A cable passes along the pulleys and forms a closed loop between the towers. A towing element is coupled to the cable for towing a user along the skiing surface. The towing system features a rigid member extending along its axis from a tower to a support surface spaced from the tower so as to form an angle with the support surface thereby holding the tower upright. The rigid member is arranged to have tension therein along its axis at the angle with an adjustable length along the axis for tensioning the cable. Also, the rigid member is substantially rigid when its adjustable length is set so as to resist movement of the tower from its set working position. Furthermore, the towing system features a measuring device arranged to measure tensile force in a tensioned member of the towing system for determining tension in the cable.

19 Claims, 25 Drawing Sheets

(56) References Cited

U.S. PATENT DOCUMENTS

| | | | | | |
|---|---|---|---|---|---|
| 3,052,470 | A * | 9/1962 | Pomagalski | B61B 11/00 | 104/173.2 |
| 3,338,180 | A * | 8/1967 | Stecker | B61B 11/00 | 104/173.2 |
| 3,376,829 | A * | 4/1968 | Hancock | B61B 11/00 | 104/173.2 |
| 3,417,710 | A * | 12/1968 | Kokes | B61B 11/00 | 104/173.2 |
| 3,561,366 | A * | 2/1971 | Pomagalski | B61B 11/004 | 104/173.2 |
| 3,739,728 | A * | 6/1973 | Thompson | B61B 11/00 | 104/173.2 |
| 3,743,278 | A * | 7/1973 | Rixen | A63C 11/10 | 104/173.2 |
| 4,353,307 | A * | 10/1982 | Munson | B61B 11/00 | 104/173.2 |
| 4,523,525 | A * | 6/1985 | Foster | B61B 11/00 | 104/117 |
| 6,152,044 | A * | 11/2000 | Bouvier | B61B 12/06 | 104/173.1 |
| 7,156,714 | B2 * | 1/2007 | Kian | B61B 11/00 | 104/173.1 |
| 8,736,459 | B2 * | 5/2014 | Ouellet | A63B 69/187 | 104/112 |
| 8,746,148 | B1 * | 6/2014 | Niedermeyer | B61B 7/02 | 104/117 |
| 2012/0186483 | A1 * | 7/2012 | Farr | B61B 7/02 | 104/173.2 |
| 2013/0213255 | A1 | 8/2013 | Von Lerchenfeld | | |

* cited by examiner

RIGID TENSIONING MEMBER AND TENSION MEASURING DEVICE FOR A TOWING SYSTEM FOR TOWING A USER ON A SUPPORT MATERIAL

This application is a continuation-in-part of U.S. parent application Ser. No. 14/710,155 filed May 12, 2015.

FIELD OF THE INVENTION

The present invention relates generally to a towing system for towing a user on a support material, and more particularly the present invention relates to a towing system comprising towers arranged relative to a skiing surface defined by the support material and fixedly supported on respective support surfaces.

BACKGROUND

Towing systems for towing a user along a skiing surface defined by a support material like water, having towers which are stationary relative to the skiing surface, are growing in popularity. In the context of watersports as an example, fixed tower towing systems reduce a number of variables that affect performance of each watersports participant. For example, fixed tower towing systems afford adjustment of tension in a cable which spans over the water and to which the watersports participants are attached by means of a towing element. Responsiveness of the towing system to actions of the participants, so that they may spring off a surface of the water, is related to the tension in the cable. In competition settings, the number of variables in the towing system should be reduced or the variables controlled in order to provide a fair competition environment. As such, maintaining near same responsiveness of the towing system, and consequently performance thereof, can be achieved by adjusting the tension in the cable based on a weight of each participant, so each participant has a fair set of course conditions. The tension in the cable may also be adjusted according to the participant's skill level or preferences (i.e., greater tension provides ability to spring off the water more easily) or to adjust for changes in length in the cable typically caused by stretching due to extended and harsh use which is characteristic of competition settings.

One common way of tensioning the cable is by using guy wires to pull towers of the towing system away from the cable spanning between the towers so as to stretch the cable, as in U.S. Patent Publication 2013/0123255 to Von Lerchenfeld. Alternatively, a counterweight can be used to tension the cable, as taught in U.S. Pat. No. 3,052,470 (Pomagalski) and International Patent Publication 2009/015878 (Rixen). While implementing the counterweight for tensioning the cable provides a more predictable and accurate way to fine tune tensile force in the cable, resulting towing systems implementing counterweights are bulky and not aesthetically pleasing. Furthermore, in the event that the cable breaks the towers with the tensioning arrangement have tendency to topple over. The possibility of towers toppling over presents a safety hazard for workers operating the towing system and to the participants.

Another factor impacting performance is alignment of the cable and pulleys on the towers. That is, the cable should be properly supported in a track of each one of the pulleys so as to not tend to slip off thereof. The cable has probable likelihood of becoming misaligned with the pulley when watersports participants are moving along the surface of the water in directions transverse to the cable. Proper alignment of the cable and pulleys can help to maintain consistent performance in terms of constant tension in the cable over the duration of the watersports participant's run.

Part of maintaining consistent performance includes replacement of worn or damaged parts. Through continued use, the tracks of the pulleys wear out, and it is likely that at least one motor driving at least one pulley may break and require repair. Presently, maintenance of towing systems like those cited in the foregoing references is generally tedious because replacement of the tracks of the pulleys, which necessitates replacement of the entire pulley, involves reduction of the tension in the cable in order to be able to replace the pulleys. Furthermore, motors are usually mounted high off the ground, and consequently working on same is difficult when having to handle tools and replacement parts.

The applicant provides a unique solution for fixed tower towing systems that may provide consistent and fair performance for a range of different participants and that may provide easier maintenance and overcome other potential shortcomings of the prior art.

SUMMARY OF THE INVENTION

According to a first aspect of the invention there is provided a towing system for towing a user on a support material, the towing system comprising:

a plurality of towers standing upwardly from a plurality of support surfaces, the plurality of towers being arranged relative to a skiing surface defined by the support material and each one of the plurality of towers having a base portion arranged for resting on a respective one of the plurality of support surfaces and an upper portion that is arranged to be elevated relative to the skiing surface;

a pulley structure coupled to the upper portion of said each one of the towers, the pulley structure comprising:

a shaft; and a pulley arranged for rotational motion about the shaft;

a motor on at least one of the plurality of towers that is operable to effect the rotational motion of the pulley over said at least one of the plurality of towers;

a cable passing along the pulleys of the plurality of towers so as to form a closed loop therebetween, the cable being arranged to span substantially over the skiing surface;

a towing element coupled to the cable and arranged to extend away therefrom over the skiing surface for towing the user along the skiing surface;

wherein the plurality of towers are supported on a first portion of the plurality of support surfaces;

a tensioning system coupled to at least one of the plurality of towers that is arranged to hold said at least one of the plurality of towers generally upright;

the tensioning system comprising a rigid member which is elongate and extends between an upper portion of said at least one of the plurality of towers and a respective one of a second portion of the plurality of support surfaces that is at a spaced distance from said at least one of the plurality of towers;

the rigid member being arranged to have tension therein which is adjustable for tensioning the cable, the rigid member also being substantially rigid so as to resist movement of said at least one of the plurality of towers towards the respective one of the second portion of the plurality of support surfaces.

The embodiment of the first aspect of the invention as described in more detail hereinafter may be safer than the prior art towing systems using bare guy wires in the tensioning system because the rigid member reduces likelihood of the tower toppling over by resisting movement of the tower in a direction of a force applied by the rigid member on the tower. Furthermore, using the rigid member enables implementation of a tension monitoring system in which the tensile stress within the rigid member can be monitored, especially digitally, and correlated to the tension in the cable. As such, the embodiment may afford more accurate tuning of the tension in the cable when the tension can be determined and a further safety feature of turning off the motor in the scenario that the tension in the cable exceeds a safe limit.

As previously mentioned, ability to adjust tension is important for several reasons including: (i) to accommodate different weights of riders in maintaining consistent responsiveness and performance for each rider, especially in a competition setting; (ii) to create selectability of responsiveness and performance for a rider for matching the skill level or preferences thereof; and (iii) to accommodate for a change in length of the cable that is often caused by stretching due to extended and harsh use in competition settings.

Preferably, the rigid member has a tensioning length which is adjustable for varying the tension in the rigid member.

Preferably, the rigid member comprises a main portion and an extendable portion which is arranged to extend relative to the main portion for changing the tensioning length of the rigid member.

In one instance, the rigid member comprises a plurality of telescoping elements which are elongate and arranged to be slidable relative to one another in a telescoping configuration for changing the tensioning length of the rigid member.

That is, the main portion and the extendable portion each extend longitudinally along an axis of the rigid member with the extendable portion being movable relative to the main portion along the axis of the rigid member for changing the tensioning length of the rigid member.

Preferably, the main portion forms an outer channel and the extendable portion forms an inner channel movable along the outer channel, and in one arrangement the main portion includes a clamp carried thereon for clamping to the extendable portion so as to hold the main portion and extendable portion in fixed relation to one another for fixing the tensioning length.

Preferably, the extendable portion defines a flat surface along its length such that the clamp is usable at any location along said length of the inner channel.

Preferably, the clamp includes visual indicators which are operable to illuminate a pre-specified colour when a predetermined clamping pressure is reached.

In one arrangement, the main portion includes a projecting element carried on the outer channel that is biased inwardly towards a center of the outer channel so as to be operable for engaging the extendable portion.

The extendable portion thus preferably includes a stopping aperture which is aligned with the projecting element angularly of the rigid member axis with the extendable portion otherwise being substantially uninterrupted along its length. The cooperation of the projecting element and the stopping aperture acts as a fail-safe in the event that the main portion and the extendable portion begin moving uncontrollably away from one another such that the stopping aperture catches the projecting element before the extendable portion separates from the main portion along the axis of the rigid member.

In one arrangement, the extendable portion includes a plurality of setting apertures which are aligned with apertures in the main portion angularly of the rigid member axis for receiving a pin when at least one of the setting apertures is registered with at least one aperture of the main portion, and wherein the setting apertures are offset angularly of the stopping aperture.

Preferably, the tensioning system further comprises a tension monitoring system, the tension monitoring system including a measuring device arranged to measure tensile force in the rigid member for determining tension in the cable.

It is preferred that the measuring device is configured to generate an output signal when the tension in the cable exceeds a safe limit, the output signal being operable to turn off the motor.

In one arrangement, the measuring device comprises a load cell at or adjacent an upper end of the rigid member that is supported in horizontal orientation between the upper portion of the respective tower and the rigid member.

Preferably, the load cell is located at or adjacent an upper end of the rigid member but spaced below the pulley.

In one arrangement, the load cell is connected between the tower at a location thereon and the rigid member at its upper end such that there is provided a separate connecting member extending between the upper end of the rigid member and the respective tower at a different location thereon.

Preferably, the load cell and the connecting member are attached to the rigid member at a common location.

Preferably, the connecting member is movable by swiveling movement relative to the rigid member and the tower with the different location being lower than a location of connection at the upper end of rigid member such that the load cell is maintained at a prescribed orientation.

In one arrangement, the different location of the connecting member is forward of the location of the load cell on the tower so as to be further away from the rigid member.

In one arrangement, the connecting member follows an arcuate path extending forwardly then downwardly from the rigid member to the tower. This may help maintain the load cell at a prescribed horizontal orientation for determining tension in the cable as the tensioning length of the rigid member is varied which in turn affects an angle which the tower forms with the support surface on which it is supported.

According to another aspect of the invention there is provided a towing system for towing a user on a support material, the towing system comprising:

a plurality of towers standing upwardly from a plurality of support surfaces, the plurality of towers being arranged relative to a skiing surface defined by the support material and each one of the plurality of towers having a base portion arranged for resting on a respective one of the plurality of support surfaces and an upper portion above the base portion that is arranged to be elevated relative to the skiing surface;

a pulley structure at or adjacent the upper portion of said each one of the towers, the pulley structure comprising:

a shaft; and a pulley arranged for rotational motion about the shaft;

a motor on at least one of the plurality of towers that is operable to effect the rotational motion of the pulley over said at least one of the plurality of towers;

a cable passing along the pulleys of the plurality of towers so as to form a closed loop therebetween, the cable being arranged to span substantially over the skiing surface;

a towing element coupled to the cable and arranged to extend away therefrom over the skiing surface for towing the user along the skiing surface;

wherein the plurality of towers are supported on a first portion of the plurality of support surfaces;

a tensioning system coupled to at least one of the plurality of towers that is arranged to hold said at least one of the plurality of towers generally upright;

the tensioning system comprising a rigid member which is elongate and extends along an axis of the rigid member between the upper portion of said at least one of the plurality of towers and a respective one of a second portion of the plurality of support surfaces that is at a spaced distance from said at least one of the plurality of towers;

the rigid member being mounted at its lower end in a fixed location on the respective one of the second portion of the plurality of support surfaces and being connected at its upper end to the tower such that the axis of the rigid member is at an angle to the second portion of the plurality of support surfaces;

the rigid member being arranged to have tension therein along its axis at the angle with an adjustable length along said axis for tensioning the cable;

and the rigid member being substantially rigid when its adjustable length is set so as to resist movement of said at least one of the plurality of towers towards the respective one of the second portion of the plurality of support surfaces.

According to another aspect of the invention there is provided a towing system for towing a user on a support material, the towing system comprising:

a plurality of towers standing upwardly from a plurality of support surfaces, the plurality of towers being arranged relative to a skiing surface defined by the support material and each one of the plurality of towers having a base portion arranged for resting on a respective one of the plurality of support surfaces and an upper portion above the base portion that is arranged to be elevated relative to the skiing surface;

a pulley structure at or adjacent the upper portion of said each one of the towers, the pulley structure comprising:

a shaft; and a pulley arranged for rotational motion about the shaft;

a motor on at least one of the plurality of towers that is operable to effect the rotational motion of the pulley over said at least one of the plurality of towers;

a cable passing along the pulleys of the plurality of towers so as to form a closed loop therebetween, the cable being arranged to span substantially over the skiing surface;

a towing element coupled to the cable and arranged to extend away therefrom over the skiing surface for towing the user along the skiing surface;

wherein the plurality of towers are supported on a first portion of the plurality of support surfaces;

a tensioning system coupled to at least one of the plurality of towers that is arranged to hold said at least one of the plurality of towers generally upright; the tensioning system comprising an elongate tensioned member extending along an axis of the member between the upper portion of said at least one of the plurality of towers and a respective one of a second portion of the plurality of support surfaces that is at a spaced distance from said at least one of the plurality of towers;

the tensioned member being mounted at its lower end in a fixed location on the respective one of the second portion of the plurality of support surfaces and being connected at its upper end to the tower such that the axis of the tensioned member is at an angle to the second portion of the plurality of support surfaces;

the tensioned member having tension therein along its axis at the angle with an adjustable length along said axis for tensioning the cable;

and the tensioning system including a measuring device bridging the upper end of the tensioned member and the tower so as to be arranged to measure tensile force in the tensioned member for determining tension in the cable.

In one arrangement, the tensioned member is a tensioning cable.

In one arrangement, the tensioned member is the rigid member.

In one arrangement, the measuring device comprises a load cell at or adjacent the upper end of the tensioned member that is supported in horizontal orientation between the upper portion of the respective tower and the tensioned member.

Preferably, the load cell is located at or adjacent the upper end of the tensioned member but spaced below the pulley.

The measuring device is preferably configured to generate an output signal when the tension in the cable exceeds a safe limit, the output signal being operable to turn off the motor. For example, the measuring device may be operatively connected to a controller, such as a programmable logic controller, which is operatively connected to the motor for controlling same.

According to a further aspect of the invention there is provided a towing system for towing a user on a support material, the towing system comprising:

a plurality of towers standing upwardly from a plurality of support surfaces, the plurality of towers being arranged relative to a skiing surface defined by the support material and each one of the plurality of towers having a base portion arranged for resting on a respective one of the plurality of support surfaces and an upper portion that is arranged to be elevated relative to the skiing surface;

a pulley structure coupled to the upper portion of said each one of the towers, the pulley structure comprising:

a shaft; and a pulley arranged for rotational motion about the shaft;

a motor on at least one of the plurality of towers that is operable to effect the rotational motion of the pulley over said at least one of the plurality of towers;

a cable passing along the pulleys of the plurality of towers so as to form a closed loop therebetween, the cable being arranged to span substantially over the skiing surface;

a towing element coupled to the cable and arranged to extend away therefrom over the skiing surface for towing the user along the skiing surface;

wherein the rotational motion of the pulley is in a radial plane extending outwardly from the shaft;

wherein the pulley structure of at least one of the plurality of towers is arranged for pivotal motion relative to the tower about an axis transverse to the shaft so as to pivot the shaft about said axis for adjusting said radial plane relative to the radial planes of the pulleys of remaining ones of the plurality of towers such that the radial planes of the pulleys are substantially coplanar.

The embodiment of the second aspect as described in more detail hereinafter affords adjustment of the radial plane of the at least one pulley so as to help properly guide the cable over the pulleys and reduce wear of tracks of the pulley particularly due to misalignment of the cable and pulleys. Adjusting the pulley structure independently of the tower for adjusting the radial plane of the pulley is important when the tower is fixedly supported on its support surface. Furthermore, the adjustment of the radial plane may help maintain more consistent tension in the cable. Moreover, the adjustment of the radial plane may reduce cable rotation as the cable moves in its closed loop between the towers. 'Cable rotation' refers to twisting of the cable over on itself, i.e., rotation of the cable about an axis defined by each portion of the cable passing between a pair of pulleys. Cable rotation is exacerbated when the cable is loaded when the user is being towed. A properly guided cable passing through aligned pulleys should effect slower and more even wear of the tracks of the pulleys, reducing frequency with which the track of the pulleys or each pulley altogether are required to be replaced.

Preferably, the pulley structure of said at least one of the towers further comprises a support assembly, the support assembly comprising a support portion which is arranged to support the shaft and pulley and a stabilizing portion which is arranged to stabilize the support portion against tilting of the radial plane during the rotational motion of the pulley. Preferably, the support portion comprises support brackets which are oriented substantially upright, the shaft being received therebetween, and the stabilizing portion comprises stabilizer plates which are oriented transversely to the support brackets, the support brackets being disposed between the stabilizer plates. It is preferred that the support assembly has slots therein arranged for fixing the support assembly in place once the radial plane has been adjusted. Preferably, the towing system also includes a housing on said at least one of the towers that is arranged for containing the pulley structure of said at least one of the towers therein, and the stabilizer plates have laterally opposing side portions which are sized and shaped to afford the pivotal motion of the pulley structure within the housing and relative thereto. It is also preferred that the towing system further includes a tensioning system arranged to hold said at least one of the towers generally upright, and the support portion of the support assembly has a mounting portion which is arranged to receive a portion of the tensioning system for coupling while affording uninterrupted rotational motion of the pulley.

In one instance, each one of the towers has a longitudinal axis which is upright and said axis transverse to the shaft is an upright axis that lies in a common upright plane with the longitudinal axis of the tower, the common upright plane spanning laterally across a width of the tower.

According to a further aspect of the invention there is provided a towing system for towing a user on a support material, the towing system comprising:

a plurality of towers standing upwardly from a plurality of support surfaces, the plurality of towers being arranged relative to a skiing surface defined by the support material and each one of the plurality of towers having a base portion arranged for resting on a respective one of the plurality of support surfaces and an upper portion that is arranged to be elevated relative to the skiing surface;

a pulley structure coupled to the upper portion of said each one of the towers, the pulley structure comprising:

a shaft; and a pulley arranged for rotational motion about the shaft;

a motor on at least one of the plurality of towers that is operable to effect the rotational motion of the pulley over said at least one of the plurality of towers;

a cable passing along the pulleys of the plurality of towers so as to form a closed loop therebetween, the cable being arranged to span substantially over the skiing surface;

a towing element coupled to the cable and arranged to extend away therefrom over the skiing surface for towing the user along the skiing surface;

wherein the rotational motion of the pulley is in a radial plane extending outwardly from the shaft;

wherein the cable comprises a first cable portion and a second cable portion adjacent thereto which are at least substantially supported by the pulley on opposing sides thereof; and a guide roller assembly coupled to the pulley structure of at least one of the plurality of towers, the guide roller assembly comprising a plurality of guide rollers which are arranged to receive the first and second cable portions therebetween and which are arranged to be rotatable about axes parallel to the radial plane for maintaining alignment of the cable and the pulley.

The embodiment of the third aspect as described in more detail hereinafter helps to maintain alignment of the cable and the at least one pulley for more consistent tension in the cable by providing a structure which properly guides the cable over said at least one pulley.

Preferably, the plurality of guide rollers comprises two pairs of guide rollers, a first one of the pair of guide rollers being arranged to receive the first cable portion therebetween and a second one of the pair of guide rollers being arranged to receive the second cable portion therebetween. Preferably, the axes of the first one of the pair of guide rollers are transverse to the first cable portion and the axes of the second one of the pair of guide rollers are transverse to the second cable portion.

According to a further aspect of the invention there is provided a towing system for towing a user on a support material, the towing system comprising:

a plurality of towers standing upwardly from a plurality of support surfaces, the plurality of towers being arranged relative to a skiing surface defined by the support material and each one of the plurality of towers having a base portion arranged for resting on a respective one of the plurality of support surfaces and an upper portion that is arranged to be elevated relative to the skiing surface;

a pulley structure coupled to the upper portion of said each one of the towers, the pulley structure comprising:

a shaft; and a pulley arranged for rotational motion about the shaft;

a motor on at least one of the plurality of towers that is operable to effect the rotational motion of the pulley over said at least one of the plurality of towers;

a cable passing along the pulleys of the plurality of towers so as to form a closed loop therebetween, the cable being arranged to span substantially over the skiing surface;

a towing element coupled to the cable and arranged to extend away therefrom over the skiing surface for towing the user along the skiing surface;

said at least one of the plurality of towers further including a housing containing the motor therein, the housing comprising an inner portion and outer sides which enclose said inner portion; and the housing further comprising at least one panel which is arranged to be moveable between a closed position in which the at least one panel defines at least a portion of the outer sides of the housing and an open position in which a portion of the at least one panel is substantially horizontal so as to provide an opening in the outer sides of the housing for accessing the inner portion thereof, the at least one panel defining a platform in the open position.

The embodiment of the fourth aspect as described in more detail hereinafter may make performing maintenance easier and/or more efficient by providing the platform for supporting tools and parts near a height of the motor and pulley, above the support surfaces, which are components of the towing system susceptible to wear and consequently repair thereof. Considering that towers may have a height in the range of 20 to 40 feet, providing a platform adjacent or at a top of the tower may make handling tools and part during maintenance considerably easier. Moreover, the platform may also be suited for supporting maintenance workers thereon so as to provide a horizontal working space defined by the platform adjacent or at the top of the tower within which the workers may manoeuver in order to conduct maintenance on parts of the towing system including the motor and pulley, which is a safer arrangement compared to working from ladders which are alongside or integrated into the tower.

Preferably, the platform defined by the at least one panel in the open is substantially horizontal for reducing likelihood of objects supported thereon from falling off of the platform. 'Platform' refers to a support surface generally horizontal in orientation which is raised relative to the ground. Preferably, the platform is arranged to support tools, parts, and workers thereon.

Preferably, the at least one panel is pivotally coupled so as to be arranged for pivotal motion about a substantially horizontal axis through the housing.

Preferably, the panel has at least one flange along at least one edge of the panel that is arranged for preventing objects placed on the platform defined by the panel in the open position from rolling off thereof.

Preferably, the at least one panel comprises a pair of opposing side panels defining opposing sides of the outer sides of the housing in the closed position.

According to a further aspect of the invention there is provided a towing system for towing a user on a support material, the towing system comprising:

a plurality of towers standing upwardly from a plurality of support surfaces, the plurality of towers being arranged relative to a skiing surface defined by the support material and each one of the plurality of towers having a base portion arranged for resting on a respective one of the plurality of support surfaces and an upper portion that is arranged to be elevated relative to the skiing surface;

a pulley structure coupled to the upper portion of said each one of the towers, the pulley structure comprising:

a shaft; and a pulley arranged for rotational motion about the shaft;

a motor on at least one of the plurality of towers that is operable to effect the rotational motion of the pulley over said at least one of the plurality of towers;

a cable passing along the pulleys of the plurality of towers so as to form a closed loop therebetween, the cable being arranged to span substantially over the skiing surface;

a towing element coupled to the cable and arranged to extend away therefrom over the skiing surface for towing the user along the skiing surface;

wherein the pulley comprises a center portion which receives the shaft therethrough and a track received in the center portion for supporting the cable, the track comprising an active track portion which is actively supporting a portion of the cable passing along the pulley and an inactive track portion which is actively free of the cable; and wherein the track of at least one of the plurality of towers further comprises a plurality of track portions defining angular portions of the track, the plurality of track portions being arranged to be removable from the center portion of the pulley such that each one of the plurality of track portions defining at least a portion of the inactive track portion is removable independent of other ones of the plurality of track portions defining at least a portion of the active track portion.

The embodiment of the fifth aspect of the invention as described in more detail hereinafter provides the pulley comprising the plurality of track portions which may make pulley maintenance easier. When the pulley comprises the track portions, the cable may be left on the pulley with the desired amount of tension therein while each track portion is freed from supporting a portion of the cable thereon and is replaced individually from other track portions that are supporting the cable such that the cable may maintain its tension. Tensioning the cable may generally be a time consuming process, so reducing a number of scenarios in which the cable has to be subsequently tensioned is advantageous for reducing the time required for maintenance of the towing system.

Preferably, said each one of the angular portions is equal in angular span.

Preferably, said each one of the plurality of track portions spans 120 degrees.

BRIEF DESCRIPTION OF THE DRAWINGS

Preferred arrangements of the invention will now be described in conjunction with the accompanying drawings in which.

In the drawings like characters of reference indicate corresponding parts in the different figures.

DETAILED DESCRIPTION

Figure 1:
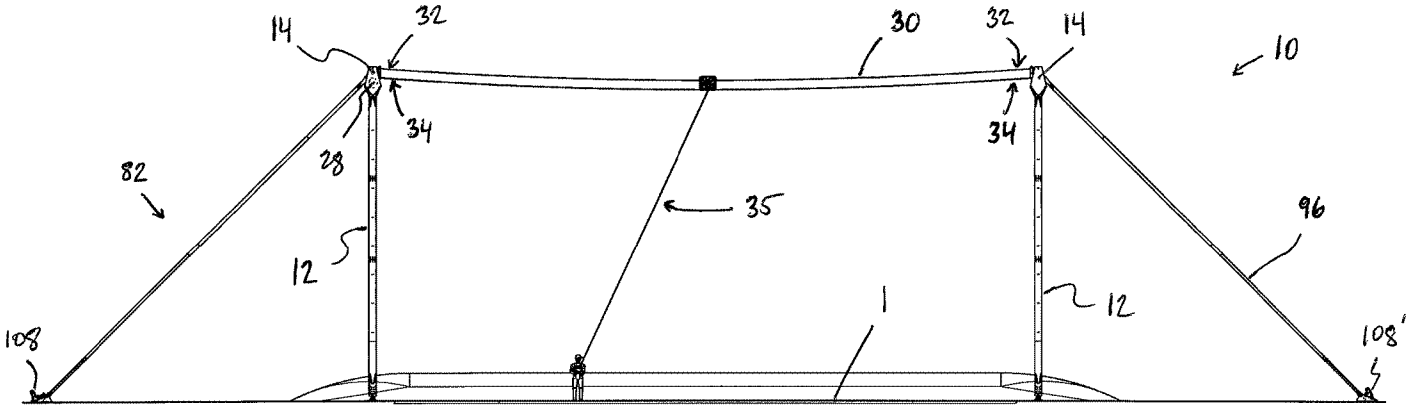
FIG. 1 is an elevation view of one arrangement of towing system of the present invention.

Referring to the accompanying figures, there is illustrated a towing system generally indicated by reference numeral 10. The towing system is suited for towing a user on a support material defining a skiing surface. 'Skiing surface' generally refers to a surface along which or across which the user is towed. The skiing surface is enclosed by an outer periphery defining boundaries of an area of the skiing surface over which the user may be towed. The area may be polygonal or of any other shape. Most often, the support material comprises water such that a surface of a body of water defines the skiing surface 1 as in the illustrated embodiment. One with normal skill in the art will recognize that the support material may also comprise snow such that a surface of the snow may define the skiing surface in an alternative embodiment. When the skiing surface is defined by the body of water, the outer periphery is generally distinct relative to an environment surrounding and external to the body of water, and when the skiing surface is defined by the surface of the snow the skiing surface may be delimited by arrangement of the towing system. The towing system is suited for watersports including wakeboarding, waterskiing, and tubing, and for winter sports and use including such activities as guiding snowboard riders or skiers through an obstacle course and towing toboggans. Typically, the user is towed along the skiing surface in a sliding movement therealong.

The towing system generally comprises a plurality of towers 12 standing upwardly from a first portion of a plurality of support surfaces. In the illustrated embodiment, the towers are arranged relative to the body of water 1, and particular arrangements of the towers relative thereto depend on the number of towers in the towing system. For example, the towers of a towing system comprising only two towers are arranged in a straight line, while the towers of a system comprising more than two towers can be arranged so as to form a polygon. The present embodiment of the invention as described in more detail hereinafter is of a towing system with two towers; however, this is meant for illustrative purposes of the various aspects of the invention and is not intended to be limiting of same. The towers are located adjacent a periphery of the body of water in the present embodiment such that the towers are out of the water.

A housing 14 is coupled to each one of the towers at a top thereof. The housing comprises an inner portion and outer sides which enclose the inner portion.

The towing system also has a pulley structure 20 coupled to each one of the towers. The pulley structure is contained within the inner portion of the housing. The pulley structure comprises a support assembly 22; a shaft 24; and a pulley 26 arranged for rotatable motion about the shaft in a radial plane extending outwardly therefrom. The support assembly is arranged to support the shaft and consequently the pulley. The shaft is horizontally oriented so that the radial plane is oriented vertically.

The towing system further comprises at least one motor 28 on at least one of the towers. The motor is operable to effect the rotational motion of the pulley 26 of the pulley structure on the corresponding tower. The motor is coupled to the support assembly 22 of the pulley structure and is contained within the inner portion of the housing.

A cable 30 passes along the pulleys of the towers so as to form a closed loop therebetween. As such, the cable is arranged to span substantially over the body of water 1. The cable comprises a first cable portion 32 and a second cable portion 34 which is opposite and adjacent thereto. Each of the first and second cable portions defines a section of the cable that is at least substantially supported by the pulley on opposing sides thereof. These sections of the cable include a portion of the cable within each of the first and second cable portions that is supported on the cable and a portion of the cable that extends away from the pulley and from the tower, generally towards the body of water. The cable may be, though is not limited to, a braided synthetic or metal rope, an endless loop of chain, or an endless belt. For a remainder of this description, the cable will be referred to as a running cable.

In addition, a towing element 35 is coupled to the running cable and arranged to extend away therefrom over the water 1 for towing a watersports participant along the water. The towing element may be a T-bar, another cable, or any other type of attachment known to a person with ordinary skill in the art. As such, the running cable is tensioned in order to afford the watersports participant ability to spring off a surface of the water for performing tricks or overcoming obstacles.

Turning now to the towers in more detail, each one of the towers has a base portion 36 arranged for resting on a respective one of the first portion of the support surfaces. The base portion has two leg portions 38 on laterally opposing sides of the tower that stand upwardly from the respective one of the first portion of the support surfaces. The legs extend upward therefrom and laterally inward towards an opposing one of the legs. The legs are joined laterally across a width of the tower by a cross member portion 40 of the base portion. Each one of the legs is hinged at a bottom thereof, where each leg meets the first portion of the support surfaces, so that the tower is arranged for pivotal motion relative to the first portion of the support surfaces about a lateral axis through the bottoms of the legs. The hinges 42 of the legs afford tilting of the tower in a forward direction, generally toward a portion of the running cable passing between the towers, and in a rearward direction, generally away from the portion of the running cable passing between the towers. Furthermore, the hinges are mounted to the first portion of the support surfaces so that the tower is fixed relative thereto.

Further to the base portion, each tower has an upper portion 44 that is arranged to be elevated relative to the body of water. The upper portion is fixedly supported on the base portion 36 so as to stand upwardly therefrom. The upper portion comprises a lower cross member portion 46 which meets the cross member portion 40 of the base portion of the tower. The upper portion further comprises laterally opposing side member portions 48 which extend upwardly from the lower cross member portion and laterally inward towards one another. An upper cross member portion 50 of the upper portion of each of the towers joins the side members at upper ends thereof. Further to the upper and lower cross member portions, the upper portion has additional cross braces 52 generally in the form of an X that are located intermediate the upper and lower cross member portions for bracing the side members.

Turning now to the pulley of the pulley structure in more detail, the pulley 26 comprises a center portion 54 which receives the shaft therethrough. The pulley also comprises a track 56 received in the center portion. The center portion of the pulley comprises two opposing circular plates which sandwich the track therebetween. A first one of the circular plates 58 has a hub protruding laterally outwards in opposite lateral directions from a center of the first circular plate for receiving the shaft therethrough. Then, a second one of the circular plates 60 is received on the hub of the first circular plate so as to be substantially parallel to the first circular plate.

Figure 21:
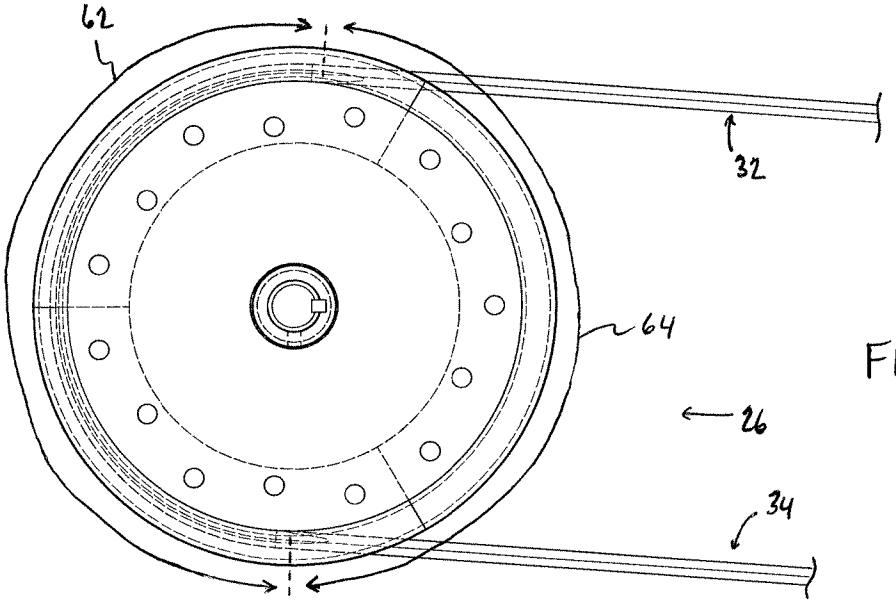
FIG. 21 is a side elevation view of the pulley in FIG. 20.
Figure 23:
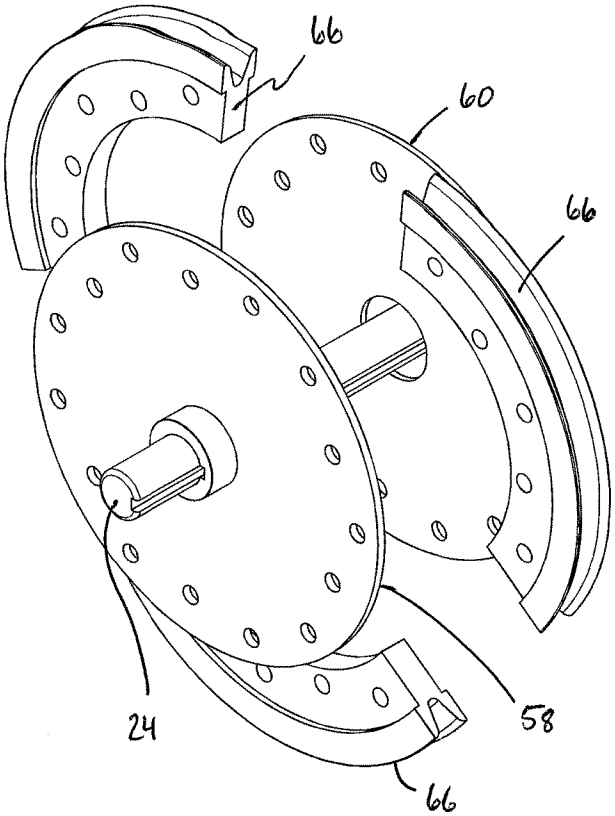
FIG. 23 is an exploded view of the pulley in FIG. 20.
Figure 24:
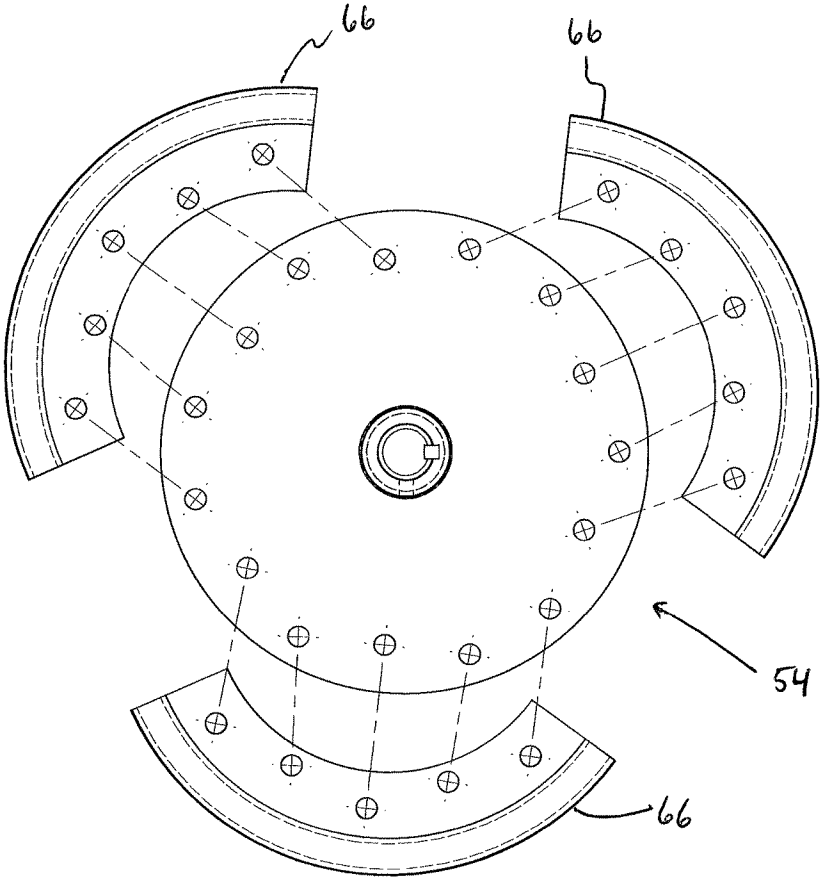
FIG. 24 is a further exploded view of the pulley in FIG. 20.
Figure 25:
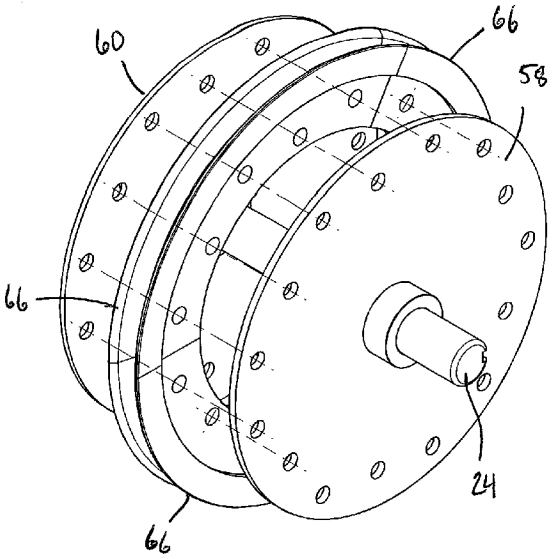
FIG. 25 is yet another exploded view of the pulley in FIG. 20.
Figure 26:
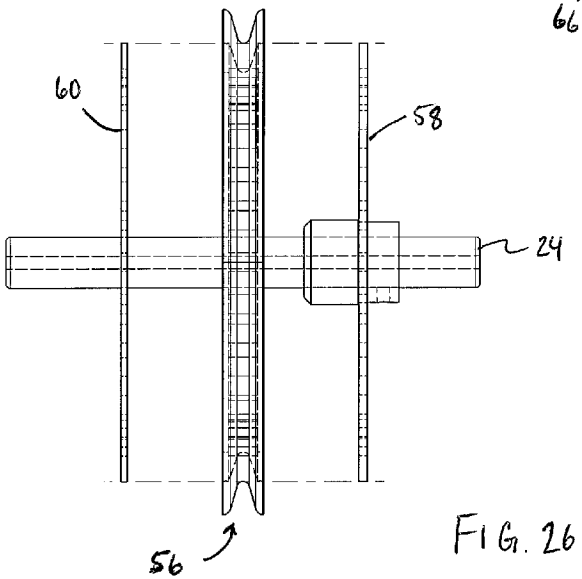
FIG. 26 is yet a further exploded view of the pulley in FIG. 20.
Figure 27:
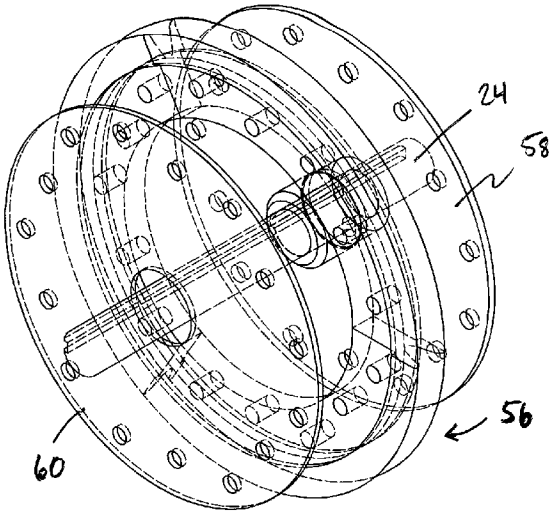
FIG. 27 is yet a further exploded view of the pulley in FIG. 20.
Figure 28A:
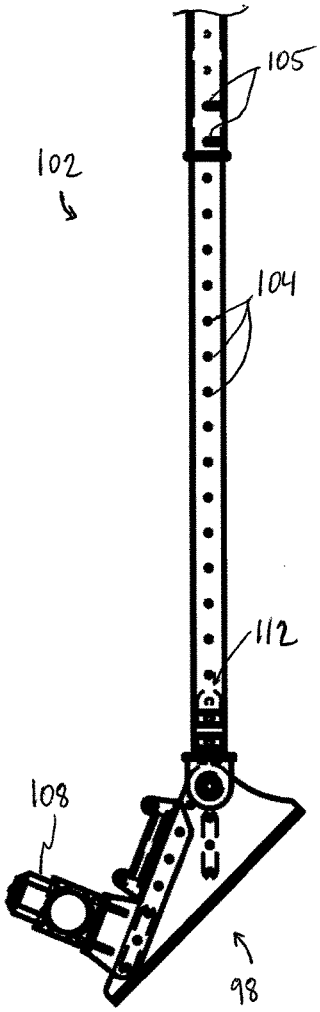
FIG. 28A is a cross-sectional view of an extendable portion of a rigid member along line 28-28 in FIG. 28B.
Figure 28B:
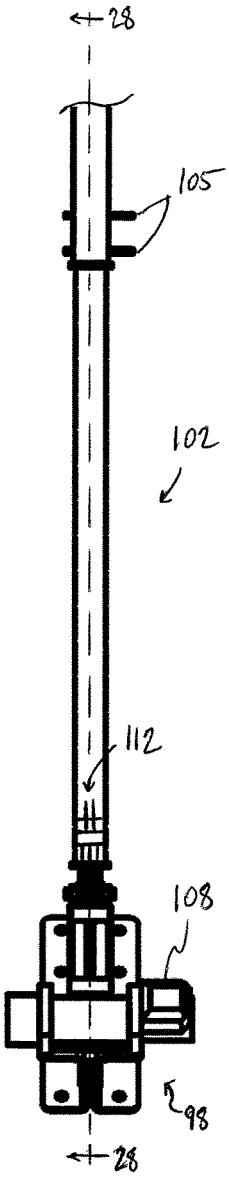
FIG. 28B is a top plan view of the extendable portion of the rigid member.
Figure 29A:
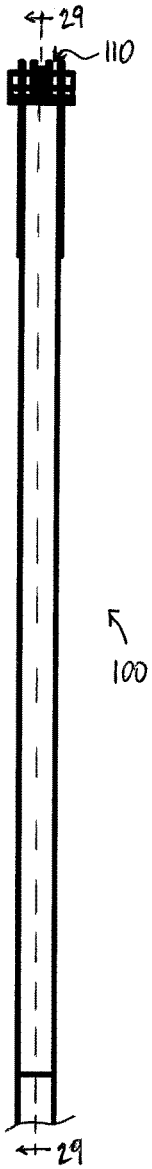
FIG. 29A is a top plan view of the main portion of the rigid member showing the location of a first one of the tensioning pulleys.
Figure 29B:
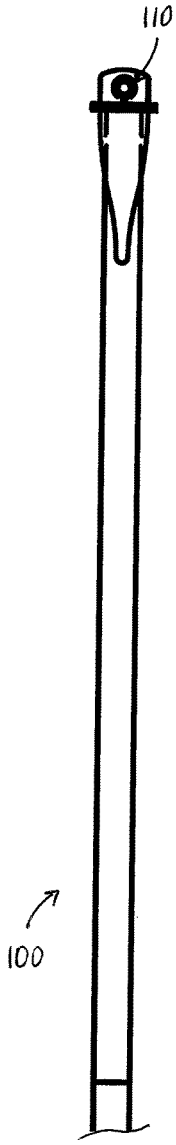
FIG. 29B is a cross-sectional view of a main portion of the rigid member along line 29-29 in FIG. 29A.
Figure 30A:
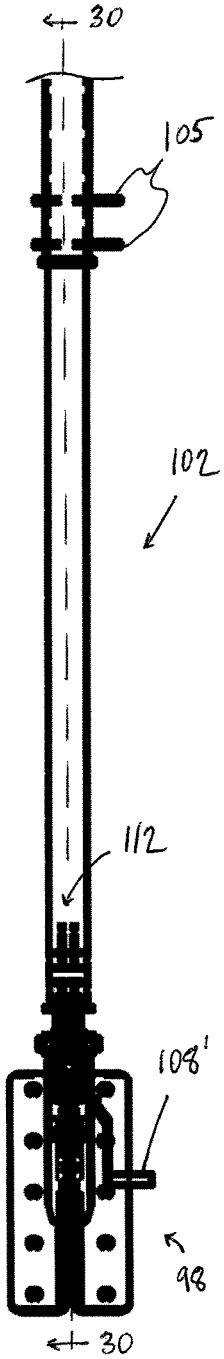
FIG. 30A is a top plan view of the extendable portion of the rigid member illustrating a manual winch.
Figure 30B:
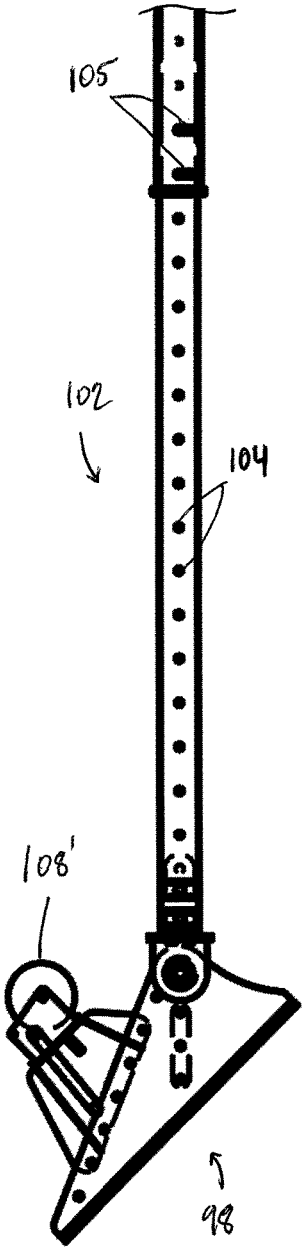
FIG. 30B is a cross-sectional view of the extendable portion of the rigid member along line 30-30 in FIG. 30A.
Figure 30C:
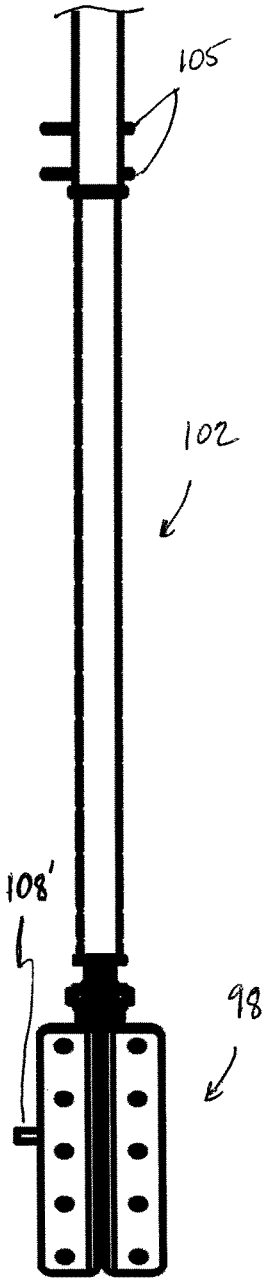
FIG. 30C is a bottom view of the extendable portion of the rigid member in FIG. 30A.
Figure 31:
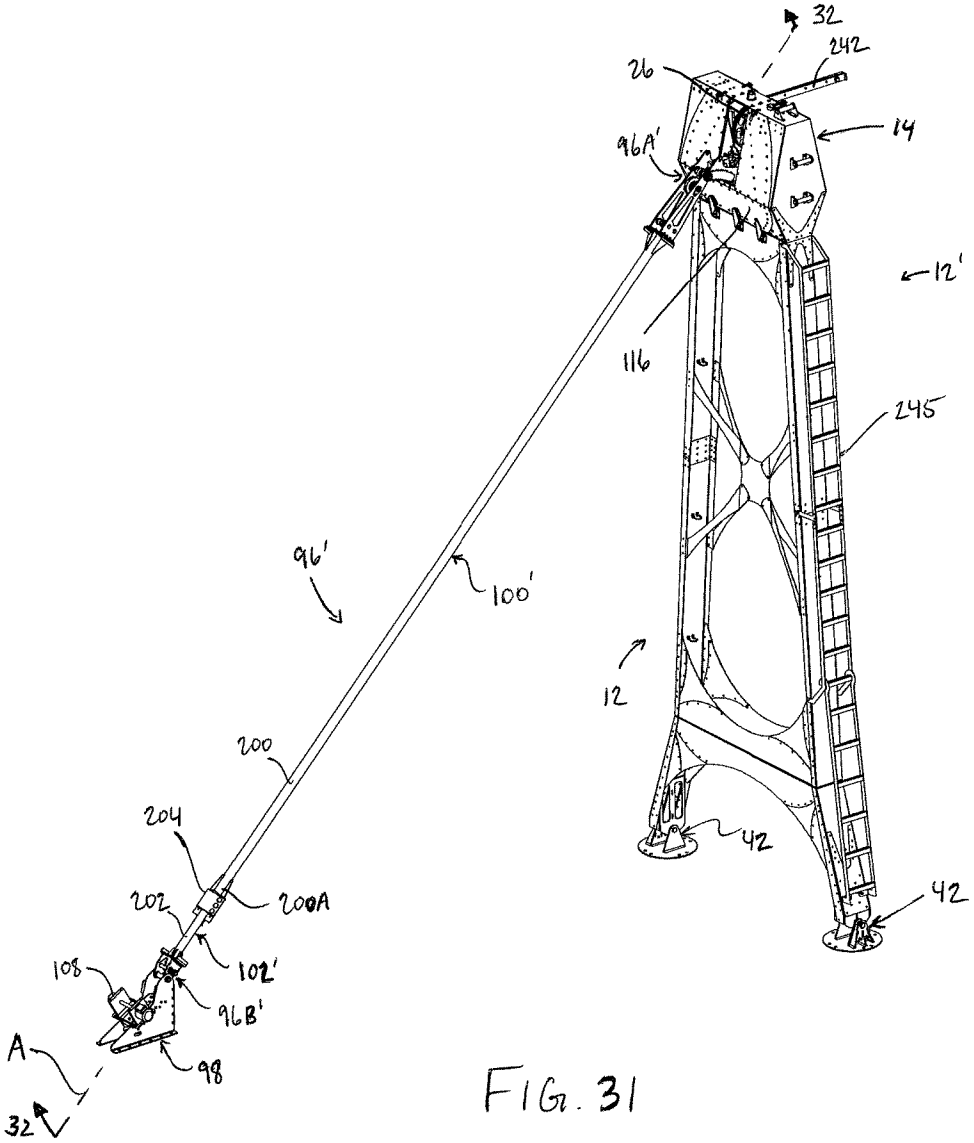
FIG. 31 is a perspective view from the rear of a second arrangement of towing system showing one tower carrying a motor and a tensioning system.
Figure 32:
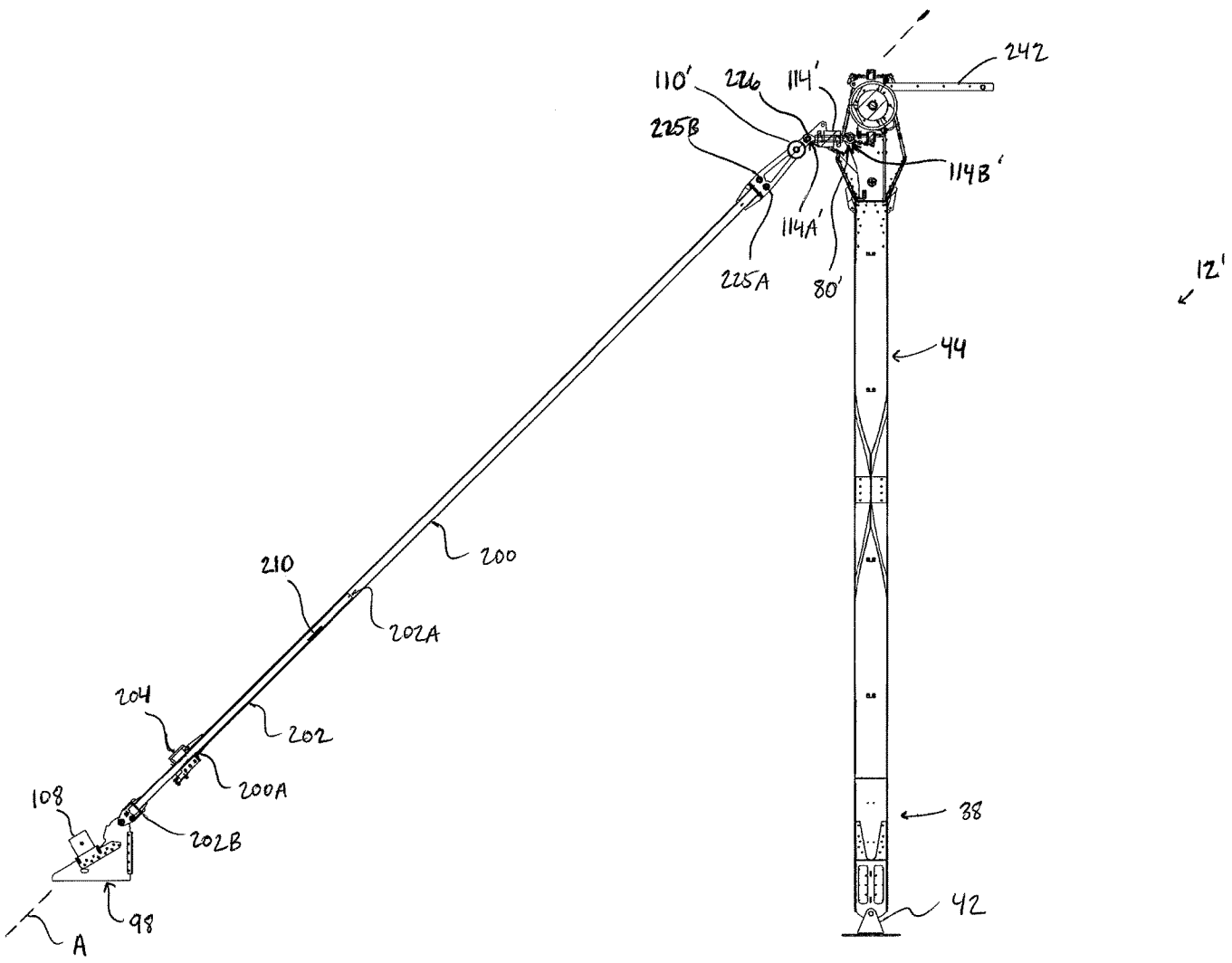
FIG. 32 a cross-sectional view along line 32-32 in FIG. 31.
Figure 33:
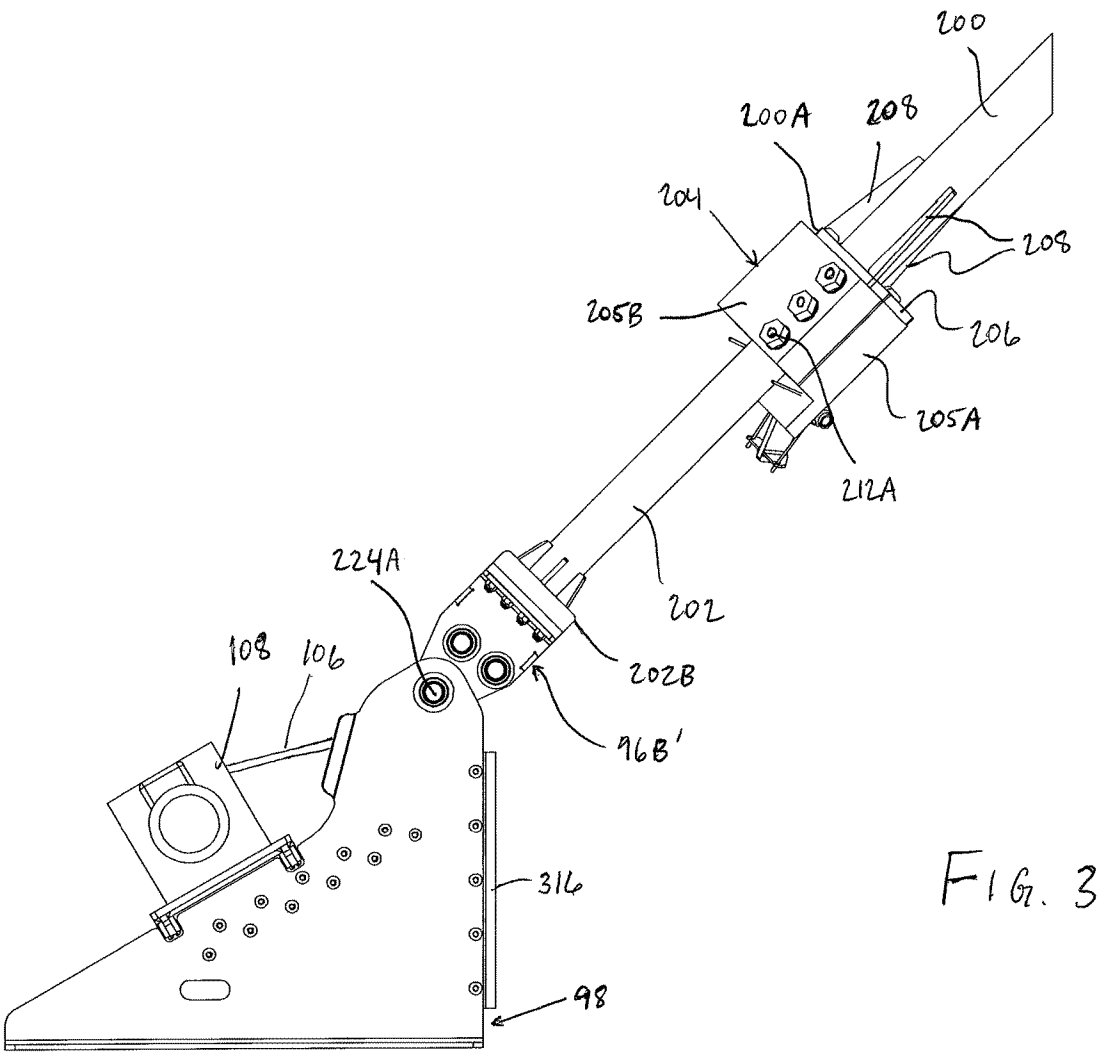
FIG. 33 is an enlarged side elevational view of the tower in FIG. 31 showing a lower end of the tensioning system.
Figure 35:
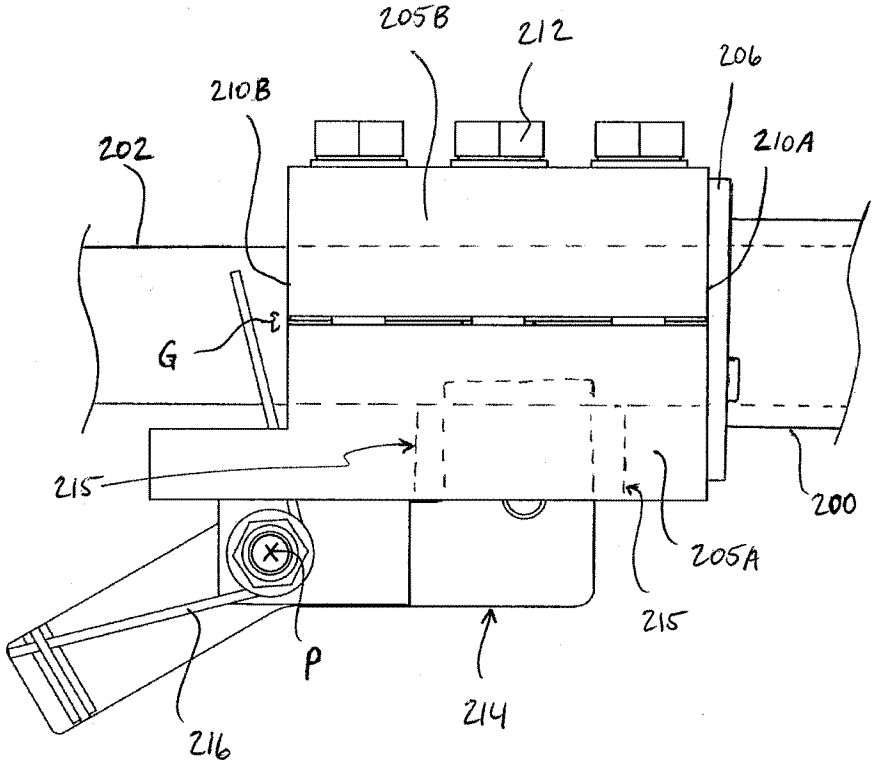
FIG. 35 is a side elevational view of the tensioning system as shown in FIG. 34.

As more clearly illustrated in FIG. 21, the track 56 of the pulley comprises an active track portion 62 which is actively supporting a portion of the running cable 30 passing along the pulley and an inactive track portion 64 which is actively free of the running cable. Furthermore, the track has a plurality of track portions 66 defining angular portions of the track. The plurality of track portions are arranged to be removable from the center portion 54 of the pulley such that each one of the plurality of track portions defining at least a portion of the inactive track portion 64 is removable independent of other ones of the plurality of track portions defining at least a portion of the active track portion 62. That is, each one of the plurality of track portions is independently removable of other ones of the plurality of track portions as more clearly shown in FIGS. 23-24; an angular size of the plurality of track portions is selected so that at least one of the plurality of track portions may be removed while at least another one of the track portions is actively supporting a portion of the running cable that is passing along the pulley, so that the tension in the running cable does not have to be decreased nor the running cable removed from the pulleys while replacing at least one of the plurality of track portions. The plurality of track portions are bolted to the center portion of the pulley through the circular plates of the center portion and the plurality of track portions. Each one of the plurality of track portions defines an equal angular portion of the track of the pulley that spans 120 degrees.

Turning now to the support assembly of the pulley structure in more detail, the shaft 24 is fixedly coupled to the support assembly 22. The support assembly is arranged for pivotal motion relative to the housing 14 about a central upright axis 68. The central upright axis is transverse to the shaft and bisects the support assembly and housing. Furthermore, the central upright axis is aligned with an upright longitudinal axis of the tower, which bisects the tower, so that the central upright axis lies along the upright longitudinal axis of the tower. As such, the pivotal motion of the support assembly affords the shaft to be pivoted about the central upright axis for adjusting the radial plane to be aligned with radial planes of the pulleys of the other towers. Alignment of the radial planes of the pulleys involves adjusting the radial planes to be substantially coplanar. Extent of the alignment of each radial plane by the support assembly is generally in the order of a few degrees and compensates for misalignment of the towers because it is difficult to adjust lateral positions of the towers once each tower is mounted to the respective one of the first portion of the support surfaces. Once the radial planes are aligned, the support assembly is fastened in place so as to not afford further pivotal motion about the central upright axis while the towing system is in use. The alignment of the radial planes of the pulleys reduces wear of the track of the pulley when the running cable is not properly supported in the tracks of the pulleys.

The support assembly comprises a support portion which is arranged to support the shaft and pulley. The support assembly also includes a stabilizing portion which is arranged to stabilize the support portion against tilting of the radial plane in lateral directions during the rotational motion of the pulley.

The support portion comprises a pair of support brackets 70 spaced apart from one another in a substantially parallel condition. Each one of the support brackets is oriented substantially upright. The pair of support brackets is centered about the central upright axis of the support assembly. Furthermore, the pair of support brackets are disposed between opposing stabilizer plates 72 which are horizontally oriented and parallel to one another. The support brackets meet each one of the stabilizer plates at right angles such that the stabilizer plates are oriented transversely to the support brackets. The stabilizer plates collectively define the stabilizing portion of the support assembly.

Each one of the support brackets is elongate and is generally L-shaped when viewed from an end of the support bracket. Each support bracket has a front bracket portion 74 which faces generally in the forward direction of the tower and a main bracket portion 76 facing in a lateral direction. In their parallel condition the support brackets are oriented so that the front bracket portions thereof protrude from the main bracket portions laterally inwardly towards an opposing one of the support brackets. The front bracket portions of the support brackets lie in a common upright plane that spans laterally across the tower. The front bracket portions of the support brackets provide a mounting location for a guide roller assembly 78 that is on each one of the towers and is discussed later.

The main bracket portions 76 of the support brackets span between a bottommost edge of each one of the support brackets and an uppermost edge thereof. The bottommost and uppermost edges are parallel to one another and flush with respective stabilizer plates. Each one of the main bracket portions has a rear edge opposite the front bracket portion of each upright plate. The rear edge has a lower edge portion, a convex edge portion 80, and an upper edge portion. The lower edge portion starts at the bottommost edge and extends upwardly therefrom. The lower edge portion meets the convex edge portion approximately midway between the bottommost and uppermost edges. As such, the convex edge portion is above the lower edge portion. The convex edge portion extends upwardly and rearwardly from the lower edge portion so as to form a vertex at a location along the rear edge that is closer to the uppermost edge than to the bottommost edge. From the vertex, the convex edge portion extends upwardly and forwardly until the convex edge portion meets the upper edge portion. The upper edge portion of the rear edge is collinear with the lower edge portion thereof. The upper edge portion terminates at the uppermost edge of the support bracket. The shaft about which the pulley rotates spans between the main bracket portions of the support brackets at a location above the vertex of the rear edge so as to be closer to the uppermost edge than to the bottommost edge. The main bracket portion of the support brackets is shaped as described to accommodate free and uninterrupted rotational motion of the pulley between the support brackets while also providing a mounting location for a tensioning system 82 coupled to each tower that is described later. As such, the convex portions of the support brackets define a mounting portion of the pulley structure for mounting the tensioning system thereto. Furthermore, in each of the towers containing a motor, the motor 28 is coupled to one of the support brackets to an outer face of the main bracket portion thereof so as to be movable with the support assembly.

The front bracket portions 74 of the support brackets also span between the uppermost and bottommost edges. Each front bracket portion has an inner edge, and the inner edges of the support brackets are spaced apart from one another. Each front bracket portion has a recessed portion 84 of the inner edge which is offset laterally outwardly so as to accommodate a portion of the pulley 26 protruding between the front bracket portions of the support brackets in a space between the recessed portions of the inner edges. The recessed portions of the inner edges are closer to the uppermost edge than to the bottommost edge of the support brackets so as to be vertically centered relative to the shaft 24.

The stabilizer plates 72 are flat and hexagonal and extend laterally beyond the support brackets. The stabilizer plates have laterally opposing side edges 86 and opposing front and rear edges which span between the side edges. The side edges of the stabilizer plates are shorter than a depth of the inner portion of the housing between a front and rear of the housing so that the support assembly has space within the housing to pivot about the central upright axis 68. The extent of the stabilizer plates laterally beyond the support brackets affords the stability of the support brackets and more generally the support assembly. Furthermore, the stabilizer plates have a plurality of slots 88 therein for fixing the support assembly in place once the radial plane has been properly adjusted. Each stabilizer plate has a portion of the slots adjacent the side edges and another portion of the slots around the central upright axis at a location in between the support brackets. The slots in the stabilizer plates are aligned with holes in the outer sides of the housing such that the support assembly can be bolted to the housing in a pivotally offset position of the support assembly.

Turning now to the guide roller assembly 78, the guide roller assembly is coupled to the front bracket portions 74 of the support brackets of the support assembly of each one of the towers. As such, the guide roller assembly is also movable with the support assembly. The guide roller assembly comprises a plurality of guide rollers which are arranged to be rotatable about axes parallel to the radial plane for maintaining alignment of the running cable and the pulley. The guide roller assembly comprises two pairs of guide rollers spaced forwardly from the front bracket portions of the support brackets and mounting brackets 90 arranged for mounting to the front bracket portions. A first one of the pairs of guide rollers 92 is arranged to receive the first cable portion 32 therebetween and to be rotatable about upright axes which are transverse to the first cable portion. A second one of the pairs of guide rollers 94 is arranged to receive the second cable portion 34 therebetween and to be rotatable about upright axes which are transverse to the second cable portion. Furthermore, axes of the guide rollers are centered relative to the radial plane on either side thereof. In the present embodiment, respective guide rollers on respective lateral sides of the radial plane are vertically aligned with each other so that their upright axes are aligned. Further to the guide rollers, the mounting brackets comprise an uppermost mounting bracket located at a top of the first pair of guide rollers; a lowermost mounting bracket located below the second pair of guide rollers; and an intermediate mounting bracket disposed between the two pairs of guide rollers. The guide rollers are free to rotate about their respective axes relative to the mounting brackets.

Turning now to the tensioning system 82, the tensioning system is arranged to hold the tower 12 generally upright. The tensioning system is also used to stretch the running cable so as to establish a desired amount of tension in the running cable. The tensioning system comprises a rigid member 96 which is elongate and extends between the support assembly 22 on the tower and a respective one of a second portion of the support surfaces that is at a spaced distance from the tower. An upper end of the rigid member is coupled to the support assembly between the support brackets at the convex edge portions 80 thereof. A lower end of the rigid member, which is opposite the upper end thereof, has a mounting portion 98 which is mounted to the respective second portion of the support surfaces. In the illustrated embodiment, the rigid member forms a 45 degree angle with the respective one of the second portion of the support surfaces. Furthermore, the angle formed by the tower and rigid member is approximately 45 degrees as well. However, in alternative embodiments, the rigid member is oriented more vertically such that the angle between same and the respective one of the second portion of the support surfaces is greater than 45 degrees and the angle between the rigid member and the tower is less than 45 degrees in order to achieve sufficing tension in the running cable. Orienting the rigid member more vertically may also reduce sag in the rigid member caused by the weight of the rigid member. The rigid member is arranged to have tension therein which is adjustable for tensioning the running cable. Additionally, the rigid member is substantially rigid so as to resist movement of the tower towards the respective one of the second portion of the support surfaces, generally in a direction of a force exerted by the rigid member on the tower. In order to vary the tension in the running cable, the rigid member has a tensioning length "L" which is adjustable. As such, the rigid member comprises a main portion 100 and an extendable portion 102 which extends relative to the main portion for changing the tensioning length of the rigid member. In the present embodiment, the rigid member comprises a plurality of telescoping elements which are elongate and arranged to be slidable relative to one another in a telescoping configuration such that some of the telescopic elements are received inside one another for changing the tensioning length of the rigid member. In the illustrated embodiment, the telescoping elements comprise three telescopic tubes. A first one of the telescopic tubes, a portion thereof which defines the upper end of the rigid member, and a second one which is adjacent the first telescopic tube collectively define the main portion of the rigid member. While the main portion of the rigid member has a fixed length, the main portion includes two of the telescopic tubes for packaging and transportation purposes. A third one of the telescopic tubes, a portion thereof that defines the lower end of the rigid member, defines the extendable portion of the rigid member that is received in the main portion thereof. The extendable portion comprises a plurality of holes 104 therethrough for tuning the tensioning length of the rigid member to achieve the desired tension desired in the running cable. The extendable portion is positioned in fixed relation to the main portion, once the tensioning length is properly adjusted, by a locking pin 105 received through one of the holes in the extendable portion. In the illustrated embodiment, a pair of locking pins is received through respective holes in the extendable portion for reinforcing the fixing of the tensioning length.

The rigid member further comprises a tensioning cable 106 received therein and a winch 108 adjacent the lower end of the rigid member that is coupled to the mounting portion thereof. The tensioning cable forms at least one loop between the winch and a first one 110 of a pair of tensioning guide pulleys at the upper end of the rigid member that is received therein. A second one 112 of the pair of tensioning guide pulleys, which is at the lower end of the rigid member so as to be received therein, is arranged to guide the tensioning cable onto the winch. Each loop formed by the tensioning cable within the rigid member affords a multiplicative factor of two to the tension on the tensioning cable that can be exerted by the winch. Since tensile force exerted in the tensioning cable is approximately twice that of the desired amount of tension in the running cable in order to establish the desired amount of tension in the running cable, being based on the approximate 45 degree angle formed between the rigid member and the tower, forming additional loops can afford implementation of a less powerful winch for achieving the desired amount of tension in the running cable.

In the illustrated embodiment, the winch 108 of each tower having a motor includes a winch motor which is electric powered. Each tower not having a motor has a manual winch 108' which is typically hand-powered as electricity may not be readily provided where such towers without motors are disposed.

To tension the running cable 30, the tensioning length "L" of the rigid member is variable (i.e., the locking pin is not inserted through any one of the holes in the extendable portion) and the tensioning cable 106 within the rigid member is stretched using the winch 108 until the desired amount of tension in the running cable is achieved. Stretching the tensioning cable causes the tower 12 to be pivoted rearward about the hinges 42 of the base portion from an initial position of the tower, in which the tension in the running cable was insufficient, to a final position in which the running cable is tensioned to the desired amount. Then, the tensioning length of the rigid member is set so as to hold the tower in the final position. Afterwards, the tensioning cable is relaxed so that the rigid member is bearing an entirety of a tensile force which was initially in the tensioning cable, the tensile force that is tensioning the running cable and holding the tower in the final position. Typically, the tower with the manual winch 108' is tensioned before the tower with the electric winch 108, which is leaned toward the opposing tower. Once the tower with the manual winch is appropriately set, the tower with the electric winch is tensioned as the motorized winch is able to pull the tensioning cable 106 within the respective tower more tightly than a person operating the manual winch 108'.

Figure 6:
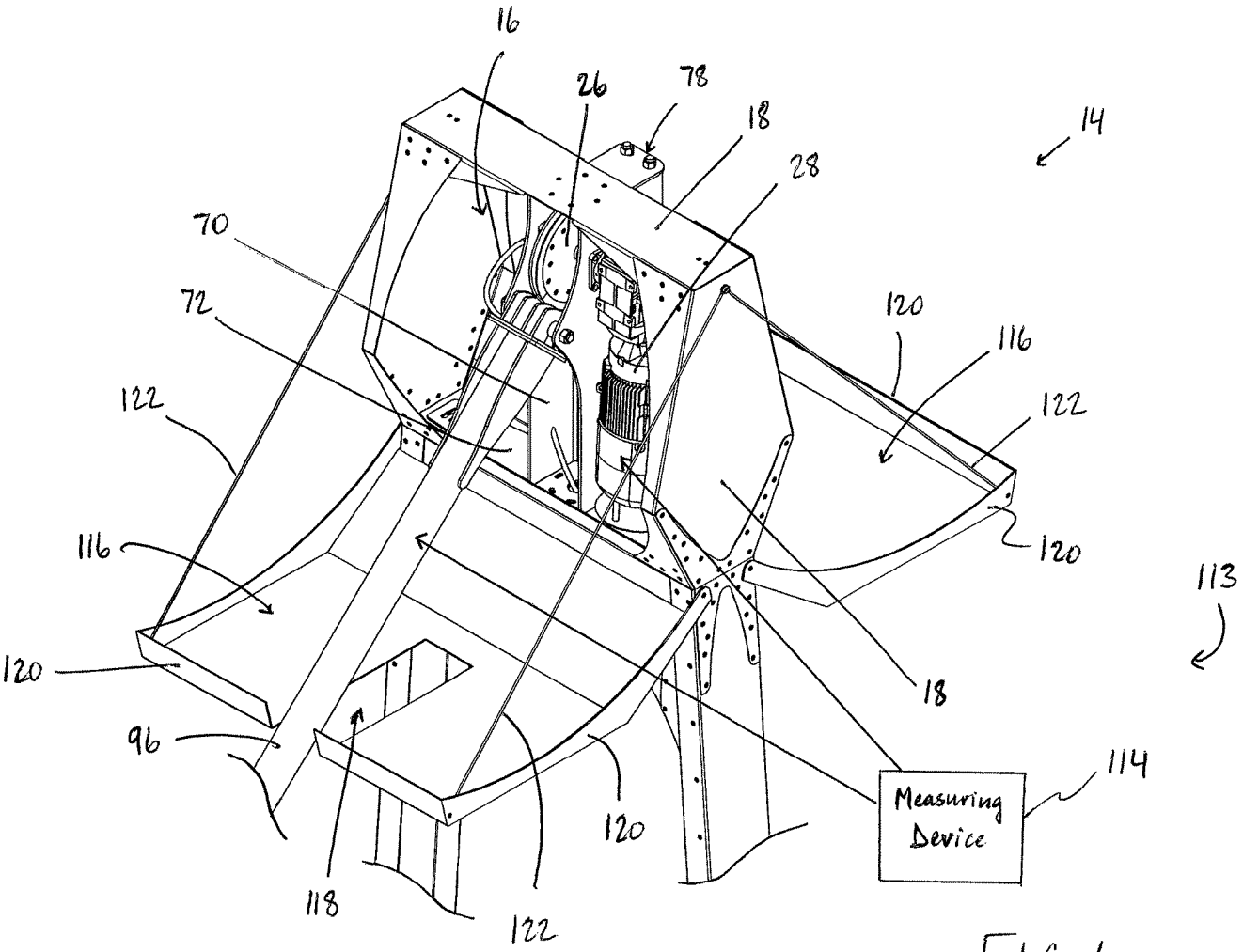
FIG. 6 is a perspective view from the rear of a housing of one tower with the panels in the open positions and a running cable omitted and a tension monitoring system schematically illustrated so as to show parts of the towing system with which the measuring device interfaces.
Figure 9:
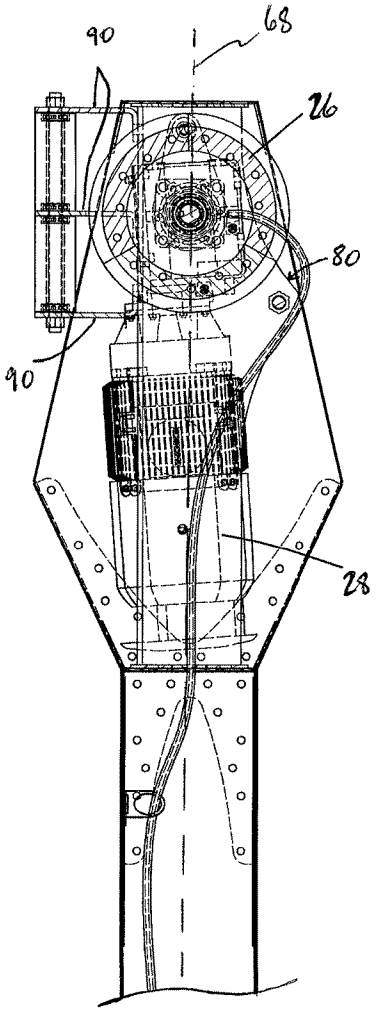
FIG. 9 is a cross-sectional view of the housing along line 9-9 in FIG. 7.
Figure 7:
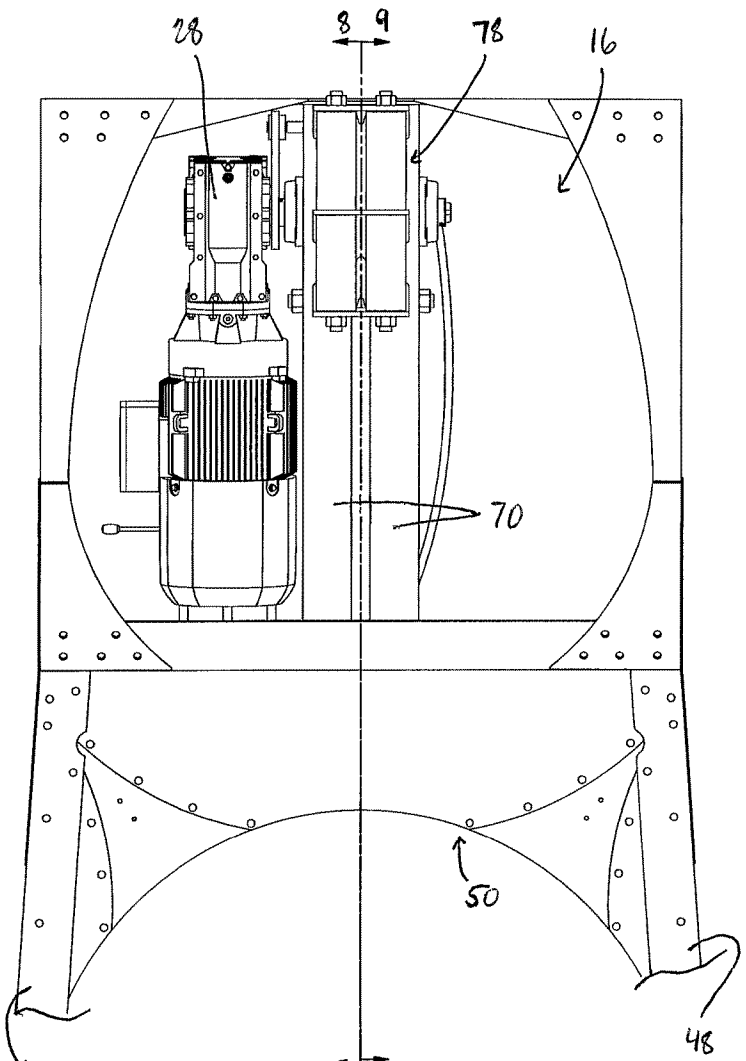
FIG. 7 is a front elevation view of the housing of one tower with the panels and running cable omitted to more clearly illustrate the inner portion of the housing.

The tensioning system further includes a tension monitoring system 113 schematically illustrated in FIG. 6. The tension monitoring system is used for monitoring tensile force in the rigid member 96 for ensuring that the desired amount of tension in the running cable is maintained. The tension monitoring system comprises a measuring device 114, like an electronic strain gauge, which is arranged to measure the tensile force in the rigid member for determining the tension in the running cable. If the tension monitoring system 113 indicates that the desired amount of tension in the running cable has been exceeded beyond a safe limit that the running cable can withstand, the tension monitoring system is also connected to the motor 28 and the measuring device is configured to generate an output signal which is arranged to disconnect power to the motor so as to turn off the motor and reduce likelihood of the running cable 30 breaking. The tension monitoring system can also be used to ensure accurate tensioning of the running cable based on weight of the watersports participant. For example, in competition settings where the tension in the running cable would have to be adjusted from participant to participant in order to guarantee a fair set of course conditions, the tension monitoring device may reduce the variability in the tension required to provide fair performance for each participant because the tension monitoring system allows operators of the towing system to determine the tension in the running cable.

Figure 8:
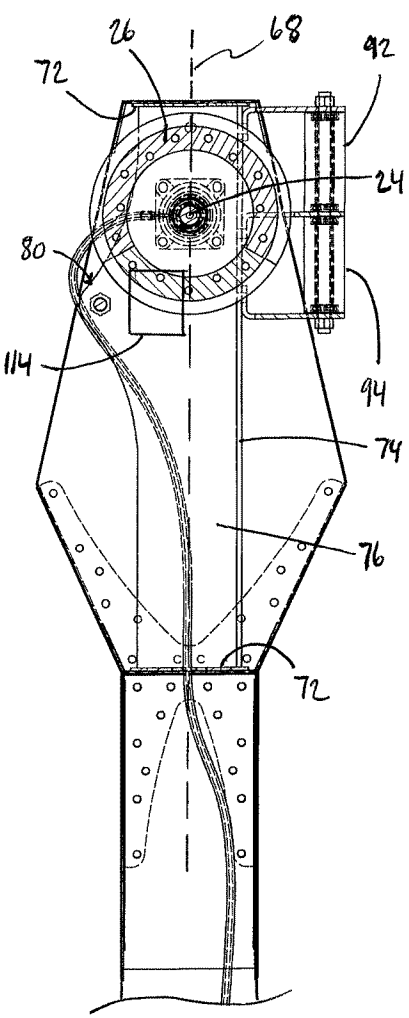
FIG. 8 is a cross-sectional view of the housing along line 8-8 in FIG. 7 that includes a measuring device of the tension monitoring system schematically represented to illustrate a preferred placement of the measuring device on a support structure.
Figure 12:
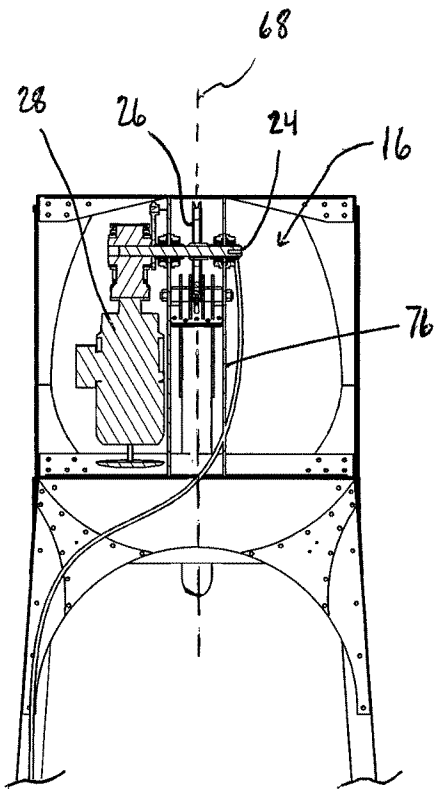
FIG. 12 is a cross-sectional view of the housing along line 12-12 in FIG. 10.
Figure 10:
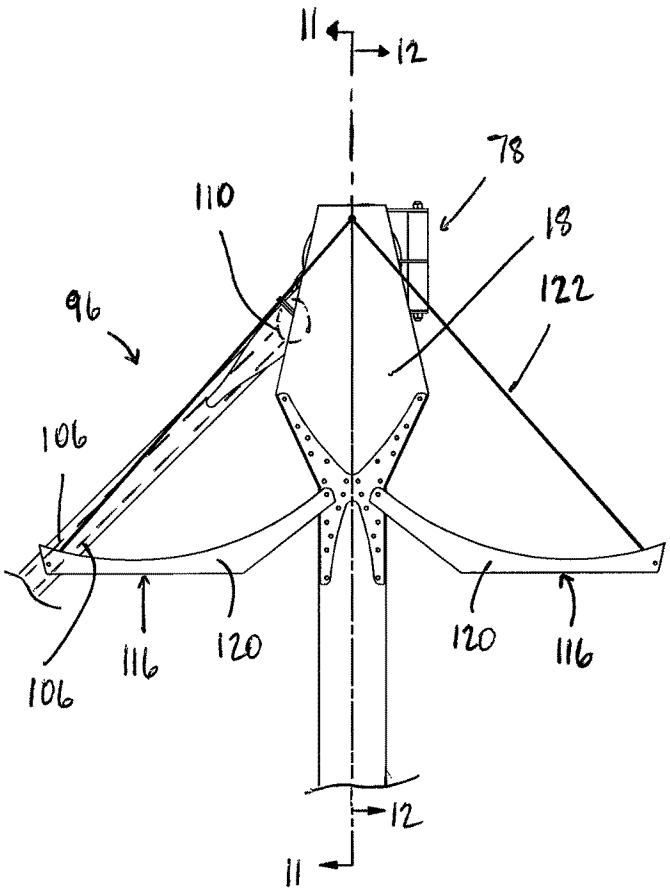
FIG. 10 is a side elevation view of the housing of one tower in FIG. 6 with the panels in the open positions.
Figure 11:
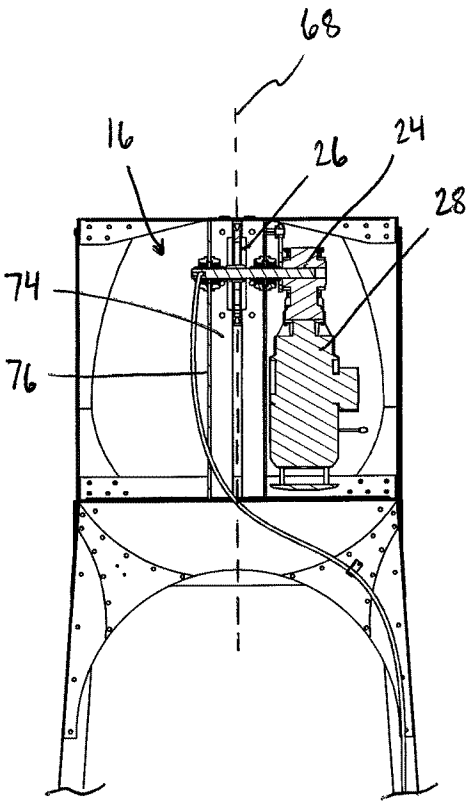
FIG. 11 is a cross-sectional view of the housing along line 11-11 in FIG. 10.
Figure 14:
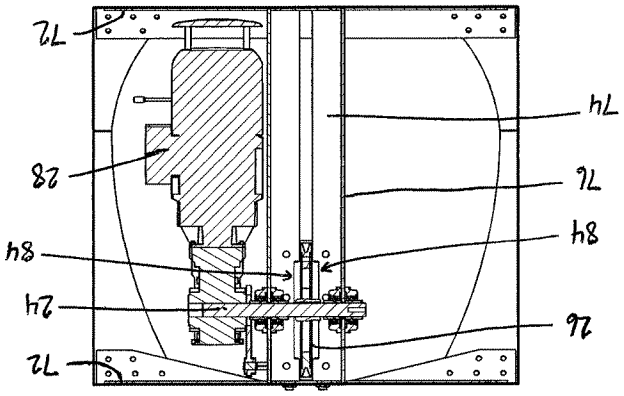
FIG. 14 is a cross-sectional view of the housing along line 14-14 in FIG. 13.
Figure 13:
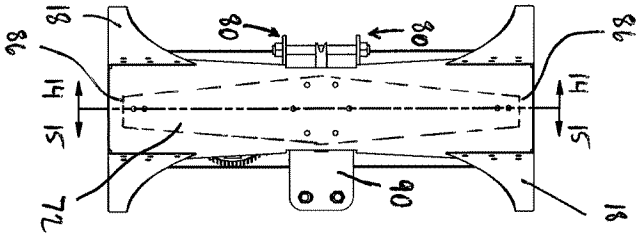
FIG. 13 is a top plan view of the housing of one tower in FIG. 6 with the panels omitted.
Figure 15:
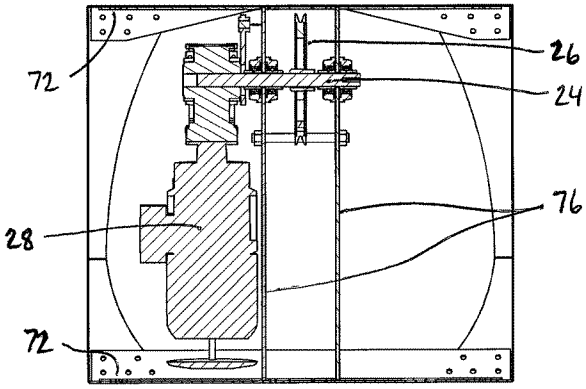
FIG. 15 is a cross-sectional view of the housing alone line 15-15 in FIG. 13.
Figure 17:
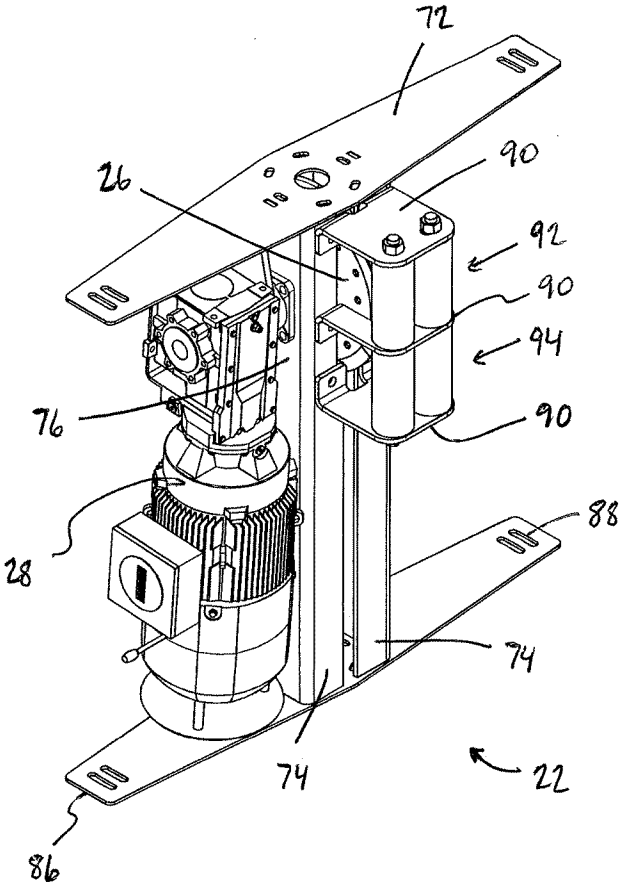
FIG. 17 is a perspective view from the front of the pulley support structure in FIG. 16.
Figure 16:
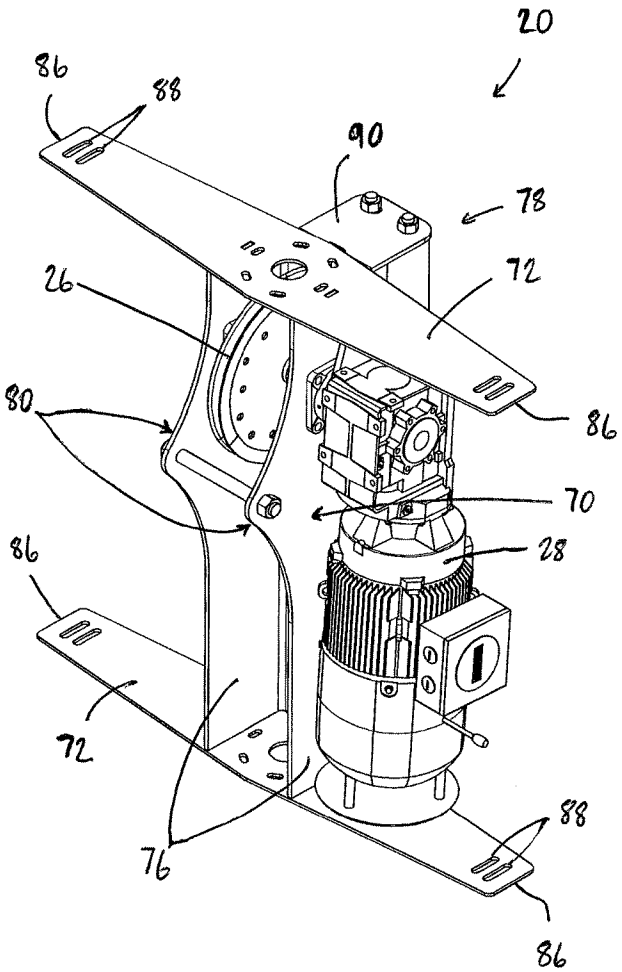
FIG. 16 is a perspective view from the rear of a pulley support structure with the housing, tower, and tensioning system omitted for clarity of illustrating the pulley support structure.
Figure 19:
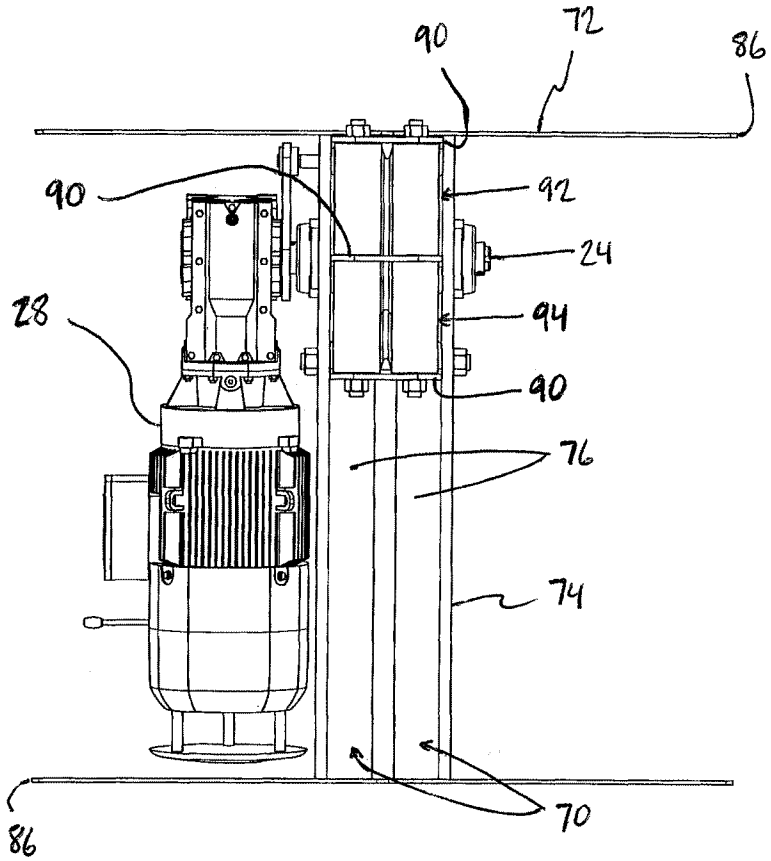
FIG. 19 is a front elevation view of the pulley support structure in FIG. 16.
Figure 18:
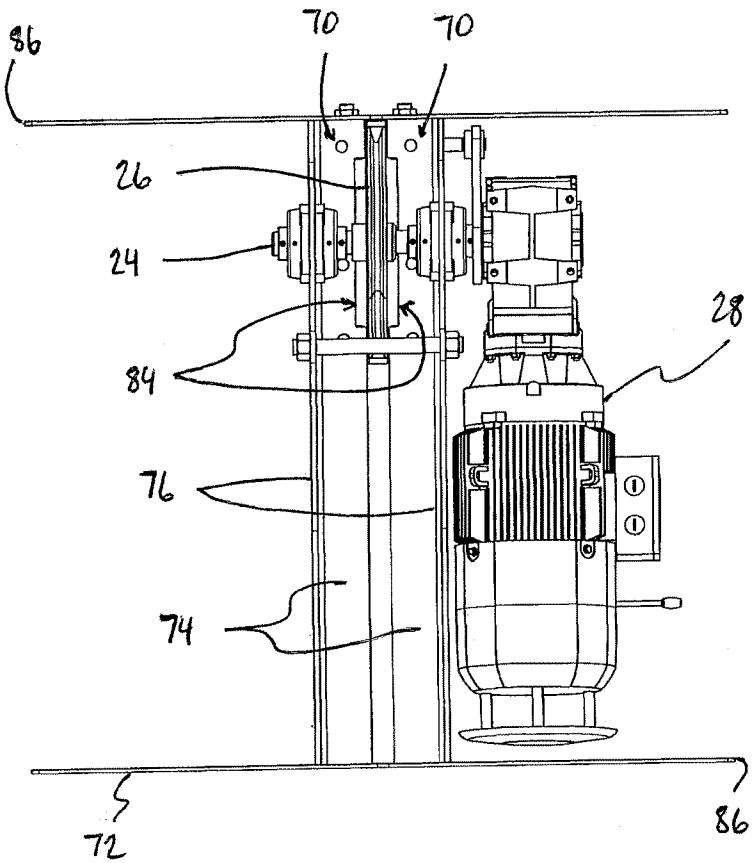
FIG. 18 is a rear elevation view of the pulley support structure in FIG. 16.
Figure 20:
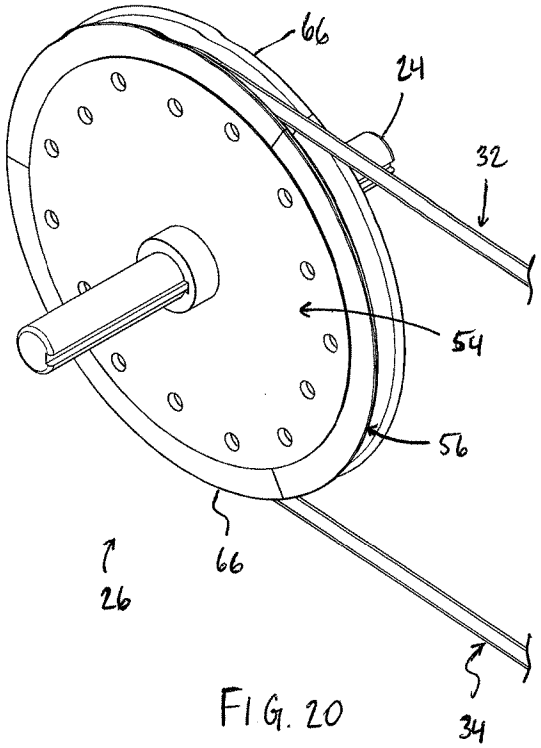
FIG. 20 is a perspective view of the pulley supporting the running cable thereon with other parts of the pulley support structure, the housing, tower, and tensioning system omitted for clarity of illustrating the pulley.
Figure 22:
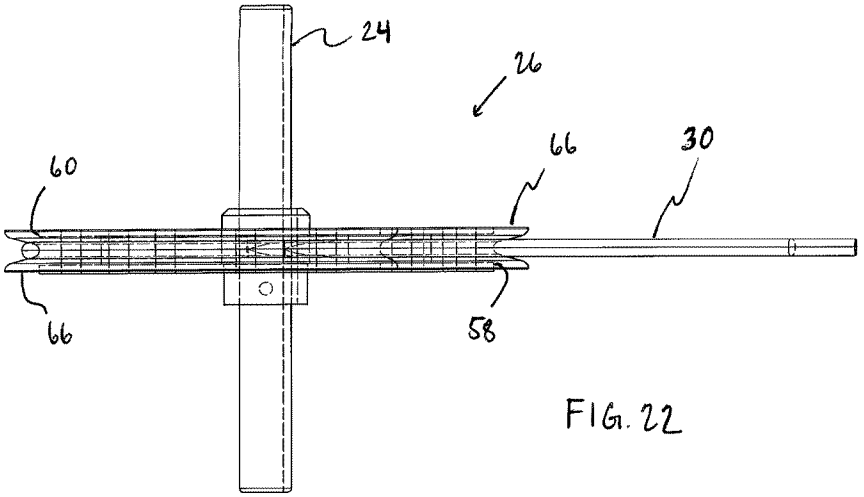
FIG. 22 is a top plan view of the pulley in FIG. 20.

In the illustrated embodiment, the measuring device is disposed on the support assembly 22 of the pulley structure. More specifically, in the illustrated embodiment the measuring device 114 is disposed at a position schematically shown in FIG. 8 at one of the support brackets intermediate the pulley shaft 24 and the convex edge portion 80 of the support bracket, where the rigid member 96 is fastened to the support assembly 22. Preferably, placement of the measuring device is on an outer face of the main bracket portion 76 of the respective one of the support brackets 70 adjacent the motor 28. Placement of the measuring device in close proximity to the rigid member 96 and the running cable 30 may provide more accurate indication of the tensile force in the rigid member and the tension in the running cable. Furthermore, the described placement of the measuring device 114 is independent or free of the rigid member, especially the portions defining the tensioning length "L", such that this placement, which in the illustrated embodiment is uniform across all towers implementing the tensioning system and the tension monitoring system 113, may provide more consistent calibration of each measuring device. The independence of the rigid member in location of the measuring device is important when rigid members of different size (e.g., overall length, cross-sectional diameter) may be used so as to be suited for towers of different height employed in a single implementation of the towing system 10 or across plural implementations thereof. In alternative embodiments, the measuring device is disposed between the support brackets 70 at a position near the pulley 26 and location of attachment of the rigid member 96 to the support brackets. It will be appreciated that in further alternative embodiments the measuring device may be disposed on the rigid member 96, tower 12, or housing 14 and be calibrated so as to function equally well as the formerly mentioned embodiments.

It will be appreciated that material from which the rigid member 96 is made may affect the calibration of the measuring device 114. As such, the material of the rigid member may be selected or designed so as to enhance the calibration. For example, the material of the rigid member may comprise one of stainless steel, mild steel, and a combination of stainless steel and mild steel.

Figure 2:
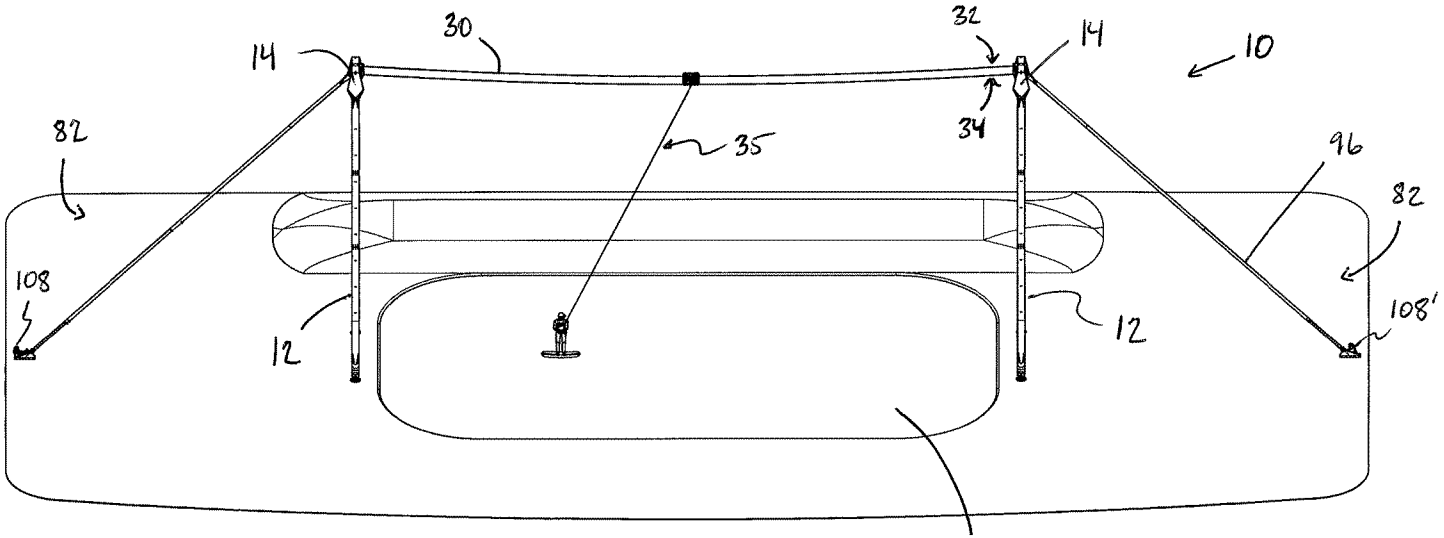
FIG. 2 is a perspective view of the towing system of FIG. 1.
Figures 3, 4:
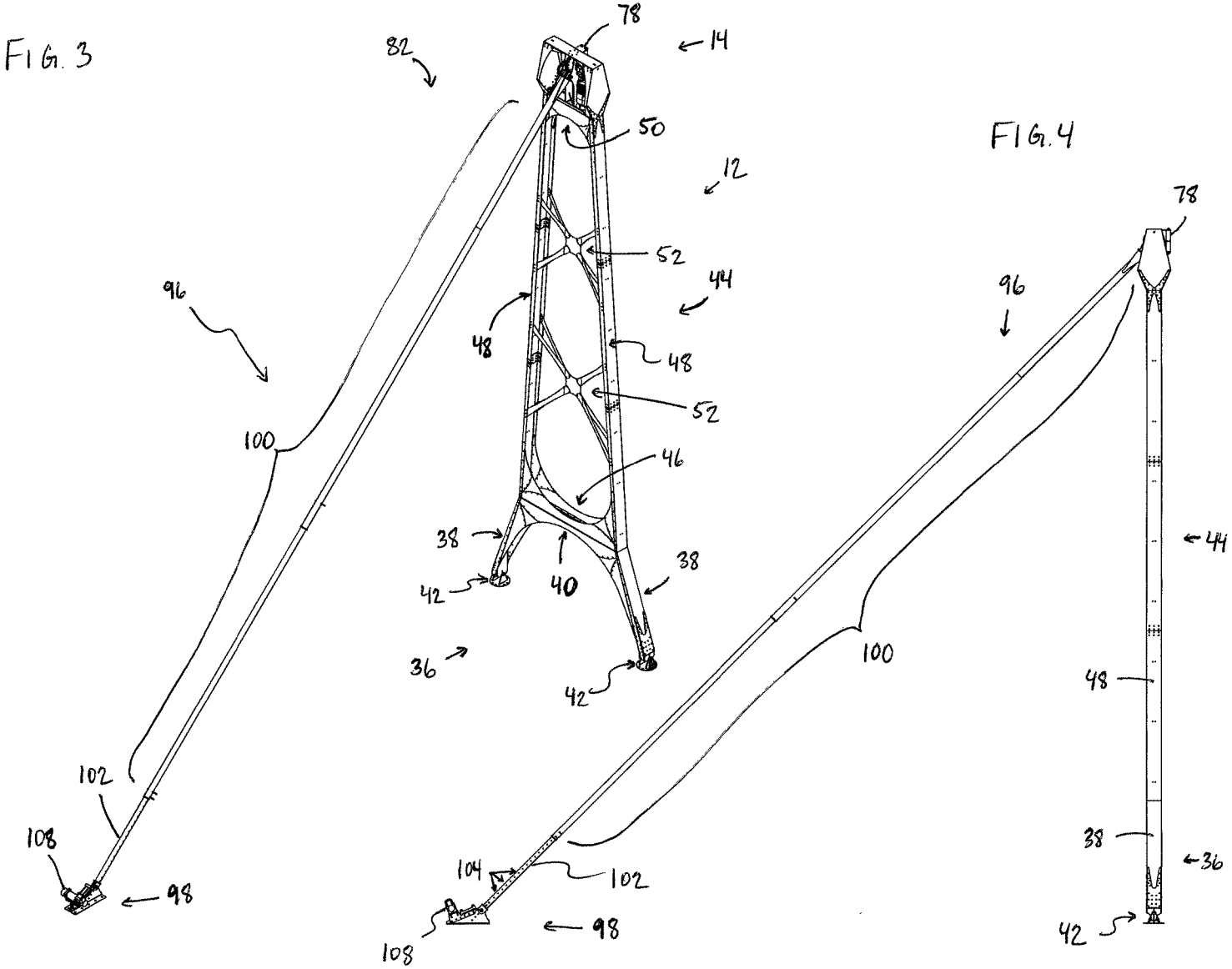
FIG. 3 is a perspective view from the rear of one tower and tensioning system of the towing system in FIG. 1 with panels of the housing removed.
FIG. 4 is a side elevation view of the tower and tensioning system in FIG. 3.
Figure 5:
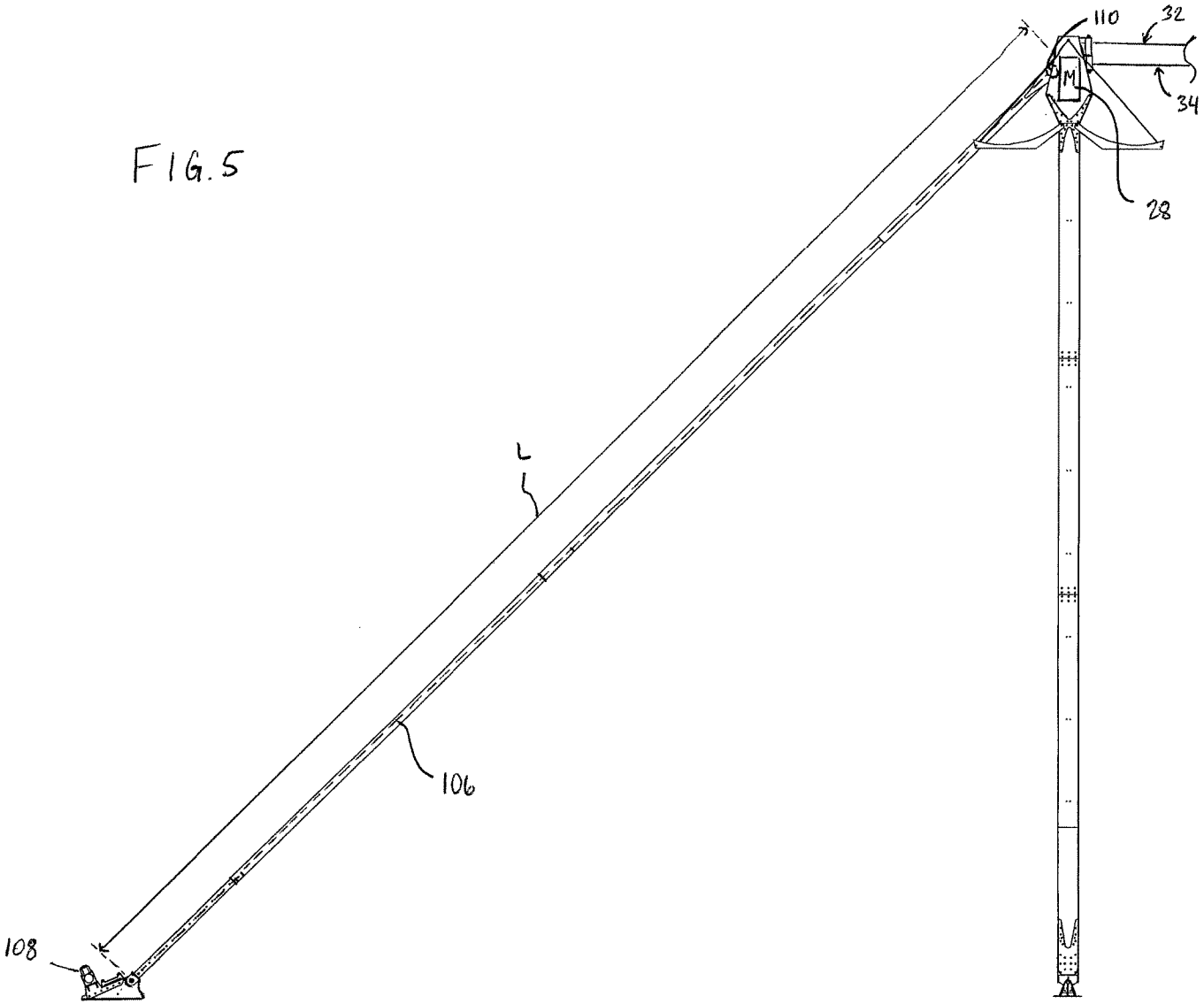
FIG. 5 is a further side elevation view of the tower and tensioning system in FIG. 3 schematically illustrating parts disposed in the rigid member.

The housing 14 on each one of the towers further comprises a pair of panels 116. Each one of the pair of panels is arranged to be movable between a closed position and an open position. In the closed position better shown in FIGS. 1-2, each panel defines a portion of the outer sides of the housing. In the open position, a portion of the panel is substantially horizontal so as to provide an opening in the outer sides of the housing for accessing the inner portion thereof; furthermore, the panel defines a platform in the open position. In the present embodiment, a first one of the pair of panels is at a front of the housing and a second one of the pair of panels is at a rear of the housing. As such, in the closed position, the panels enclose the pulley structure and the motor (if present on the tower) within the inner portion of the housing. The panels have panel slots 118 therein which are sized and shaped for affording passage of the rigid member 96 and the guide roller assembly 78 therethrough. The panel slots are formed at a top of each one of the panels so as to extend downwardly from the top thereof. Furthermore, the panels are hinged at a bottom thereof so as to be pivotally coupled to a lower portion of the housing and consequently arranged for pivotal motion about lateral axes therethrough. Furthermore, each panel has flanges 120 about outermost edges of the panel that are arranged for preventing objects placed on the platform defined by the panel in the open position from rolling off of the platform. The flanges stand upwardly from the panel in the open position. The flanges of the panels overlap a remainder of the outer sides of the housing when in the closed position. Moreover, respective support wires 122 span between the remainder of the outer sides of the housing which are fixed and each panel at outermost ends thereof so as to increase a load which can be supported on each panel in the open position; however, in alternative embodiments, the support wires may comprise higher gauge cables for providing the required load-carrying capabilities of the panel in the open position thereof. In the illustrated embodiment, the panel; hinges coupling the panel to the lower portion of the housing; and the support wires are designed for supporting (and thus to withstand the load of) parts, tools, and/or workers thereon.

In use, the towers 12 of the towing system are initially mounted on the first portion of the support surfaces relative to the body of water 1. In general, the towers may be located inside or outside a periphery of the body of water. For example, a first one of the towers may be in or above the body of water, so that the first tower is supported by a respective one of the first portion of the support surfaces located substantially in the body of water. A second one of the towers may be adjacent a periphery of the body of water, so that the second tower is supported by another one of the first portion of the support surfaces located substantially outside the body of water.

Notwithstanding specific locations of the towers, the hinges 42 of the base portion of each one of the towers are mounted to the respective first portion of the support surfaces such that the towers, each which has an upright plane containing the longitudinal axis of each of the towers that spans across the width of the tower, are aligned with the respective upright planes facing one another. This foregoing facing condition of the upright planes of the towers is a preferred alignment of towers in the towing system that comprises only two towers and may not necessarily be true of other embodiments of the towing system.

Once the towers have been mounted, the mounting portion 98 of the lower end of the rigid member is mounted to the second portion of the support surfaces. Since the towers have considerable height when standing upwardly from the first portion of the support surfaces, in an exemplary range of 20 to 40 feet, it is likely that each one of the second portion of the support surfaces may in fact be a separate support surface from respective first portions of the support surfaces supporting the towers thereon. The rigid member 96 extends rearward and downward from the pulley structure 20 towards the each one of the second portion of the support surfaces.

With the towers in place, the running cable 30 is guided along the pulleys 26 of the towers so as to form the closed loop therebetween. The pulley structure of each tower is pivotally adjusted about its central upright axis 68 so as to align the radial planes of the pulleys of the opposing towers such that the radial planes lie in a common upright plane which spans across the body of water and which is also substantially perpendicular to the upright planes of the towers.

Next, the running cable is stretched to achieve the desired tension therein, which is dependent on the weight of the watersports participant. The desired tension in the running cable is achieved by stretching the tensioning cable 106 within the rigid member so as to pull the tower rearward away from the portion of the cable spanning between the towers; setting the tensioning length "L" of the rigid member once the tower is in its final position; and relaxing the tensioning cable as per a process of tensioning the running cable described earlier. The tension monitoring system allows the operator of the towing system to tune the tensioning length of the rigid member until the desired amount of tensile force in the running cable is achieved because the tension monitoring system affords ability to determine the tension in the running cable by measuring the tensile force in the rigid member.

In the event that the running cable breaks, the rigidity of the rigid member resists the tower from moving rearwards and potentially toppling over due to the force exerted on the tower by the rigid member. As such, the tensioning system comprising the rigid member as in the present embodiment is markedly safer over tensioning systems comprising guy wires extending downwards and away from towers to achieve the desired tension in the running cable. The tension monitoring system of the tensioning system is configured to disconnect the motor in the event that the tension in the running cable exceeds its safe limit, so as to reduce likelihood of the running cable breaking. Lastly, once the running cable has been properly tensioned, the towing element 35 can be coupled to the running cable once it is tensioned.

During normal operation, the watersports participant may traverse a course along the water that is neither a projection of the running cable along the water nor is an elliptical path. In fact, portions of the course traversed by the watersports participant may be transversely oriented relative to the running cable; during these portions of the course, the running cable tends to be pulled out of the tracks 56 of the pulleys. Force applied by the participant on the running cable through the towing element, which acts transversely to the running cable, causes the first 32 and second 34 cable portions to engage the guide rollers. The guide roller assembly 78 helps maintain the alignment of the running cable and the pulley so that the running cable properly passes over the tracks of the pulleys.

With continued use, the pulleys 26 and the motor 28 are likely to require repair to replace components thereof which have worn out. Presuming that the motor works, the panel 116 at the front of the housing 14 is opened affording access to the pulley. Notwithstanding further necessity of removal of the guide roller assembly to be able to access the pulley, the motor is used to rotate the pulley until at least one of the plurality of track portions 66 seeking to be replaced defines at least a portion of the inactive track portion 64. Then, said one of the plurality of track portions is replaced, and the process of rotating the pulley in order to free other ones of the plurality of track portions from supporting the running cable 30 thereon is repeated until all necessary track portions have been replaced. During the replacement procedure of at least one of the plurality of track portions, the tension in the running cable does not have to be reduced nor does the running cable have to be removed entirely from either one of the pulleys. Furthermore, the platform defined by the front panel in the open position may be used to support tools and parts during the replacement procedure as well as the worker(s) conducting same.

To repair the motor, either one of the panels of the housing may be opened to grant access to the motor. The platforms defined by either one of the panels in the open position may be used to support tools and parts of the motor while repairing same as well as the worker(s) performing the repair of the motor.

Note that in other embodiments of the towing system in which it is used for winter sports, the cable may be installed over the ground or artificial ground surfaces covered in snow or a substance resembling properties thereof. Furthermore, the towing system may be arranged in either an outdoor or indoor environment, and the body of water may comprise, in alternative embodiments, a body of another liquid substance along which a person can be towed (e.g., mud).

In an alternative embodiment, the tensioning monitoring system includes a load cell which defines the shaft 24 of the pulley. As such, the load cell is round cylindrical in shape. The load cell is arranged to measure force on the pulley 26 due to the running cable 30. The load cell may be suited for use in combination with the measuring device 114 described hereinbefore. The load cell may also be suited as an alternative to the measuring device 114 described hereinbefore for determining tension in the running cable. Such load cells are known in the art and thus are not described in detail herein. Also, note that the shaft 24 of at least one of the towers has to be replaced with the load cell for proper functioning of the tension monitoring system; as such, it will be appreciated that in this alternative embodiment not all towers are necessarily required to have the load cell defining the shaft. Furthermore, it will be appreciated that towers that do not have the tensioning system 82 may comprise the load cell and that towers that do not have a motor 28 may comprise the load cell. In further alternative embodiments, measurement of the tension in the running cable 30 may be derived from the shaft of at least one of the towers by an arrangement different than the load cell.

In yet further alternative embodiments, one or more load cells may be disposed elsewhere in the towing system 10 in locations at which the one or more load cells may be responsive or sensitive to the tension in the running cable 30. For example, in one of the further alternative embodiments a load cell may be disposed in the towing element 35. More specifically, the load cell may be disposed in a coupling portion of the towing element 35 which is carried on the running cable 30 opposite a gripping portion of the towing element arranged to be held by the user.

Turning now to another arrangement of the towing system as more clearly shown in FIGS. 31 through 42, this second arrangement is substantially similar to the first arrangement illustrated in the preceding figures with exception of the tensioning system which has a modified structure. The rigid member is referred to as "tension bar" hereinafter for convenience of reference.

The tension bar 96' of the second arrangement comprises a two-piece telescoping arrangement with the main portion 100' forming a circular tubular outer channel 200 slidably receiving in its lower end 200A the extendable portion 102' forming an circular tubular inner channel 202. The tubular outer and inner channels thus extend longitudinally along an axis "A" of the tension bar with the tensioning cable 106 (schematically shown) received inside the channels 200, 202 along the tension bar axis. The tubular inner channel is movable along the axis A relative to the tubular outer channel for changing the tensioning length L.

The main portion 100' includes a clamp 204 carried thereon at the lower end 200A of the outer main tube. As more clearly shown in FIGS. 33 and 36, the outer tube includes a flange 206 extending radially outwardly from the outer tube 200 and about the tube's full perimeter in a radial plane of the outer tube. This flange 206 provides a mounting surface for the clamp 204 which is bolted in butting engagement with the flange. The flange is reinforced by a plurality of gusset-like plates 208 which are arranged at spaced positions angularly of one another to brace the flange 206 against an outer surface of the outer main tube 200.

The clamp 204 is arranged as a solid metal box forming a bottom base portion 205A and a top portion 205B which are hinged together at 207 on one side of the box. A circular cylindrical bore 209 of the clamp extends longitudinally of the tension bar axis A, generally matching a transverse cross-section of the tubular inner channel 202 as more clearly illustrated in FIG. 34 such that movement of the inner tube transversely of the axis A of the tension bar may be resisted in the bore 209. Thus, corresponding semi-circular grooves 209A, 209B spanning between opposite ends 210A, 210B of the clamp are formed in each portion 204A, 204B thereof. These longitudinally extending grooves provide clamping surfaces for clamping to an outer surface of the inner tube 202 so as to hold the outer and inner channels 200, 202 in fixed relation to one another for fixing the tensioning length L, that is for setting the tensioning length to a specific desired value.

The outer surface of the inner tube 202 where it may contact the clamping surfaces 209A and 209B of the clamp is flat and uninterrupted along its full length (with the exception of a stopping aperture 210 which will be described below). As such, that the clamp 204 is usable at any location of the outer surface along the length of the inner tube. That is, the outer surface of the inner tube is free of any protrusions which would otherwise interfere with the clamping surfaces. Although openings in the inner tube may not interfere with a clamping ability of clamp 204, these may reduce a structural strength of the inner tube which may be subject to significant amounts of clamping pressure and tension under operation. In the illustrated arrangement, the outer surface of the inner tube is smooth and circular cylindrical in shape so as to be flat and uninterrupted. As such, the tensioning length L is thus adjustable in minute increments so as to achieve the desired tension in the running cable.

Clamp 204 is also arranged with a gap G on either side of the bore 209 between mating surfaces 211A and 211B of the bottom and top portions 204A and 204B when these are in a working position, that is when portions 204A, 204B are arranged in opposing fashion so as to engage the outer surface of the inner tube 202 and thus apply the required clamping pressure for maintaining the tensioning length L. A series of bolts 212 are provided with their heads presented at the top portion 204B and a threaded neck depending therefrom extending through the top portion through the gap G and into the bottom portion 204A so as to hold these two portions together in the working position with a sufficient amount of clamping pressure exerted on the inner tube. The gap G is provided so that the clamping pressure is adjustable by tightening or loosening of the bolts 212 with the whole of both the bottom portion and top portion moving towards or away from one another as effected by the gap G on either side of the bore 209.

Each bolt 212 has a visual indicator 212A in the form of an illuminating spot which is operable to illuminate a pre-specified colour when a predetermined prescribed threshold clamping pressure is reached thereby indicating that the tensioning length has been safely set. For example, the bolts display a red colour until this threshold prescribed clamping pressure is reached, at which time the bolts each display a black colour. These bolts are available under the trade name SmartBolt from Stress Indicators Incorporated. Such visual indicators are easily understandable by an operator of the towing system so that the operator may safely set the tension bar without necessarily requiring tools aside from a conventional wrench for tightening the bolts 212. For example, use of such visual indicators may remove need to use a tool, such as a torque wrench, in order to tighten the clamp to a known, safe clamping pressure.

Alternatively, in other embodiments, the bolts may be conventional bolts which are tightened using a torque wrench so as to achieve a predetermined clamping pressure as indicated by reaching a predetermined torque as set on the torque wrench when tightening the conventional bolts.

For safety, such as in the event that the tensioning cable breaks during adjustment of the tensioning length where the clamp 204 is not in a ready state for holding the main and extendable portions in fixed relation to one another, there is provided a projecting element 214 on the main portion 100' that is operable for engaging the extendable portion in such an emergency so as to prevent the tower from toppling over. The projecting element is carried on the outer channel 200 in a manner so as to be biased inwardly towards a center of the outer channel so as to be operable for engaging the extendable portion.

For the tension bar 96' used with the tower having the motor (termed "motor tower" for convenience of reference hereinafter), the projecting element is a pivotal finger 214 carried on the clamp at the bottom portion 205A thereof so as to be movable by pivotal movement about a bolt defining pivot axis P through a slot 215 in the bottom portion extending radially of the axis A of the tension bar. The slot 215 extends through a full thickness of the bottom portion 205A from an outer face thereof to the groove 209A formed in the bottom portion. The pivotal finger is thus biased generally towards the axis A of the tension bar.

A conventional spring arrangement 216 biases the finger 214 in a manner so as to engage the inner tube 202. Since the outer surface of the inner tube is flat and uninterrupted where the clamping surfaces 209A, 209B contact it, the finger 214 typically butts against the outer surface during adjustment of the tensioning length L without affecting functionality related to changing the tensioning length as more clearly shown in FIG. 37. During adjustment of the tensioning length, the clamp 204 remains in a closed position such that the top and bottom portions of the clamp form the bore 209 but these portions are separated by a sufficiently large gap such that the inner channel 202 can move freely relative to the outer channel 200 along the tension bar axis A.

As briefly referenced above, there is provided a stopping aperture 210 formed in the inner tube 202 at a location which is closer to an upper end 202A located inside the outer tube 200 than to a lower end 202B connected to the mounting portion 98. The inner channel 202 is otherwise substantially uninterrupted along its length.

Figure 34:
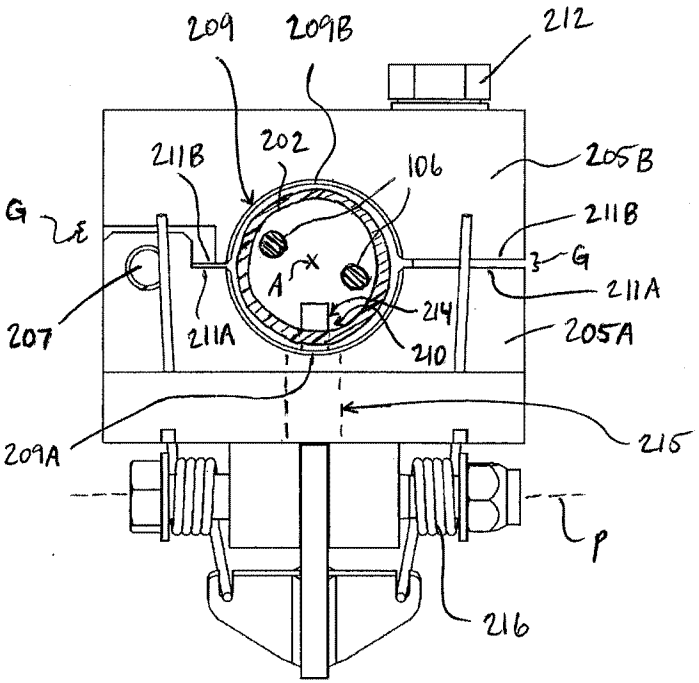
FIG. 34 is an end view of the tensioning system of FIG. 31 taken along a section of a rigid member near a stopping aperture therein with a projecting element shown inserted in the stopping aperture.
Figure 36:
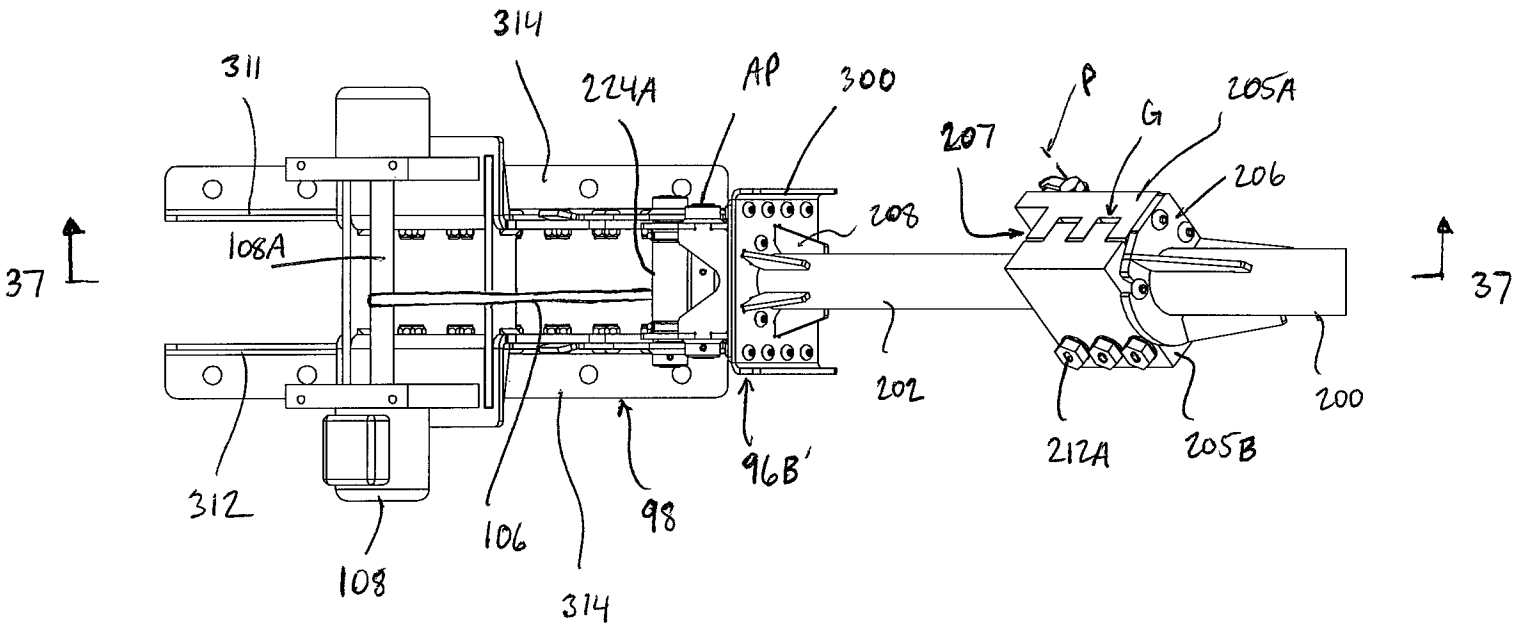
FIG. 36 is an enlarged top plan view of the tower in FIG. 31 showing the lower end of the tensioning system.
Figure 37:
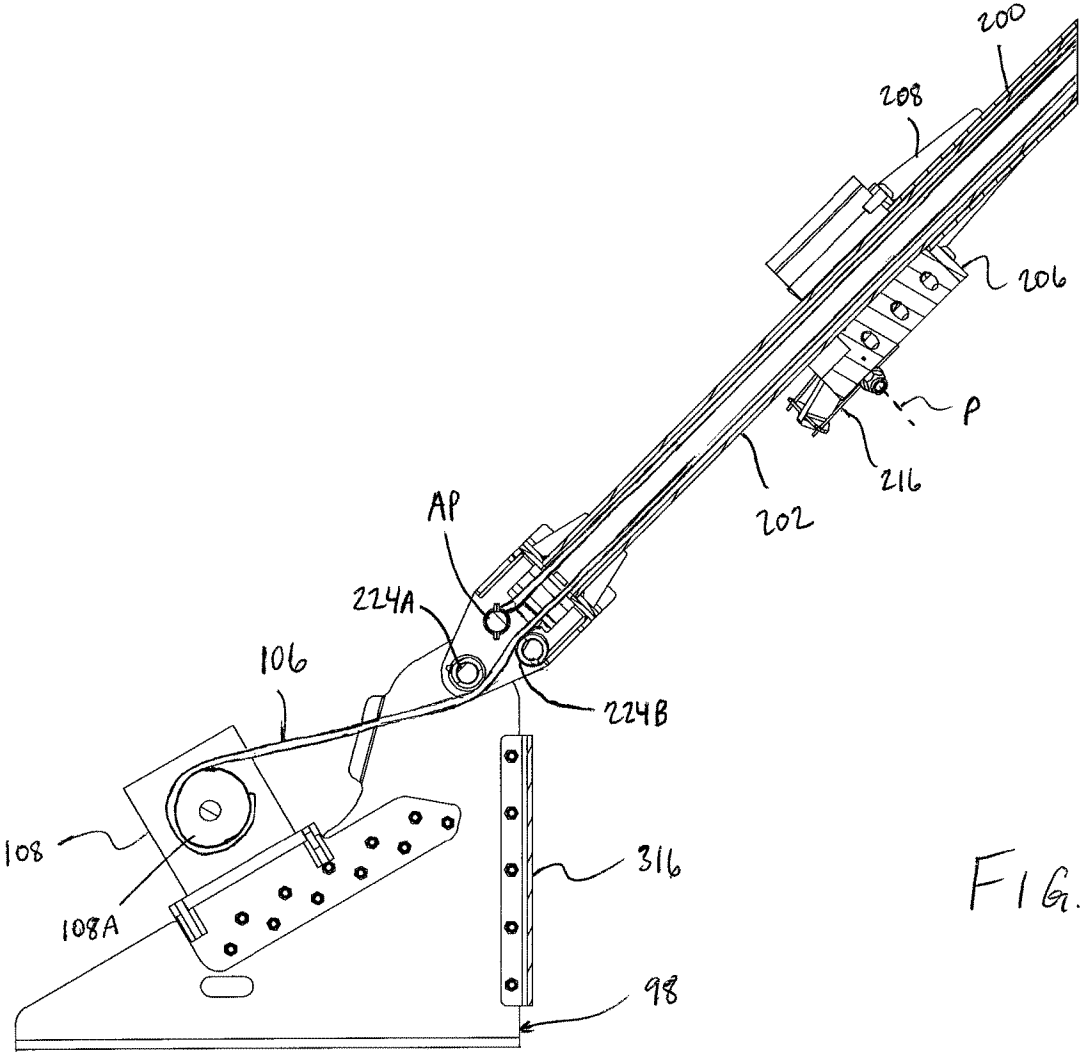
FIG. 37 is a cross-sectional view along line 37-37 in FIG. 36.
Figure 38:
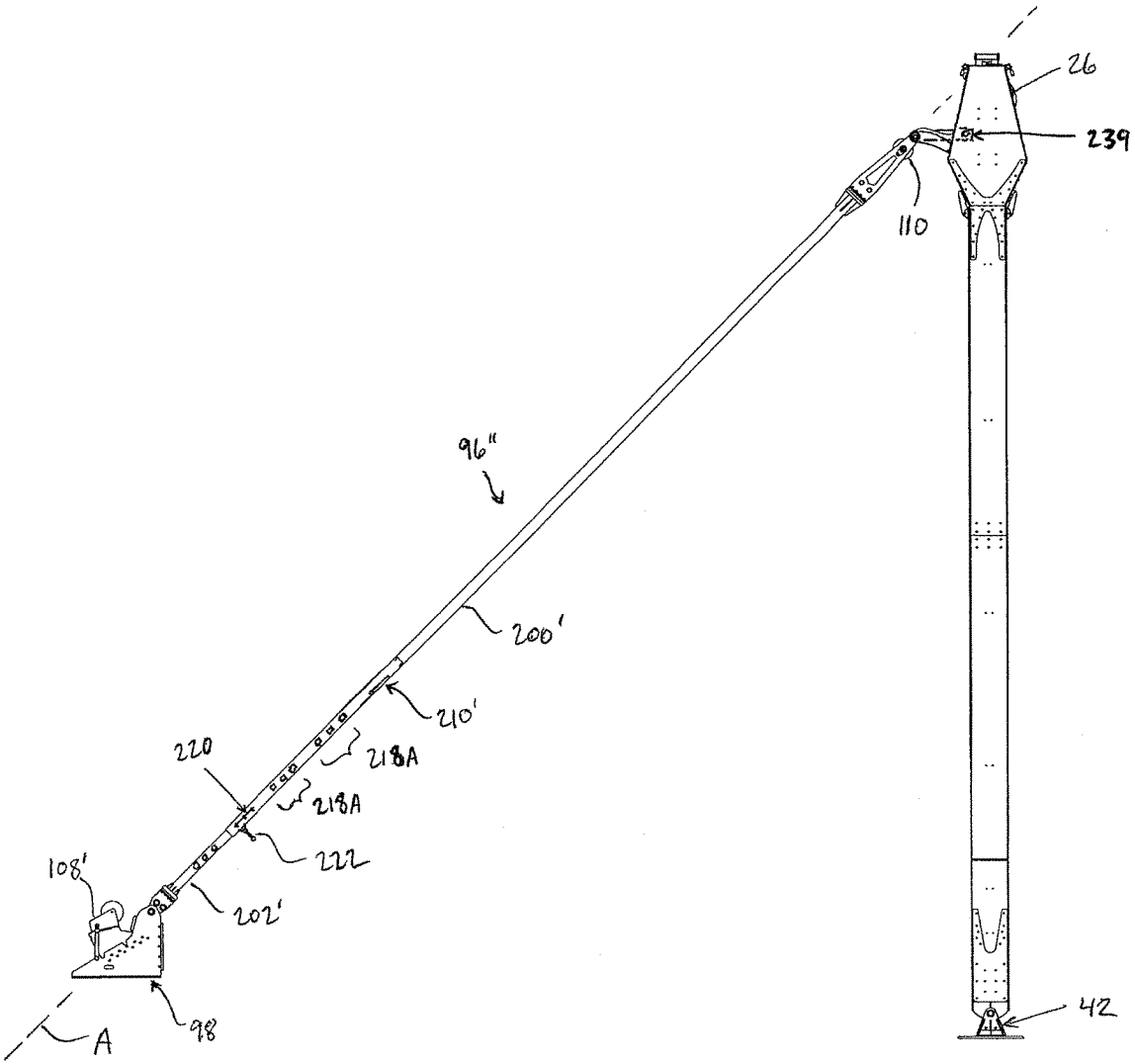
FIG. 38 is a side elevational view of another tower and tensioning system of the second arrangement where some features are shown schematically.
Figure 39:
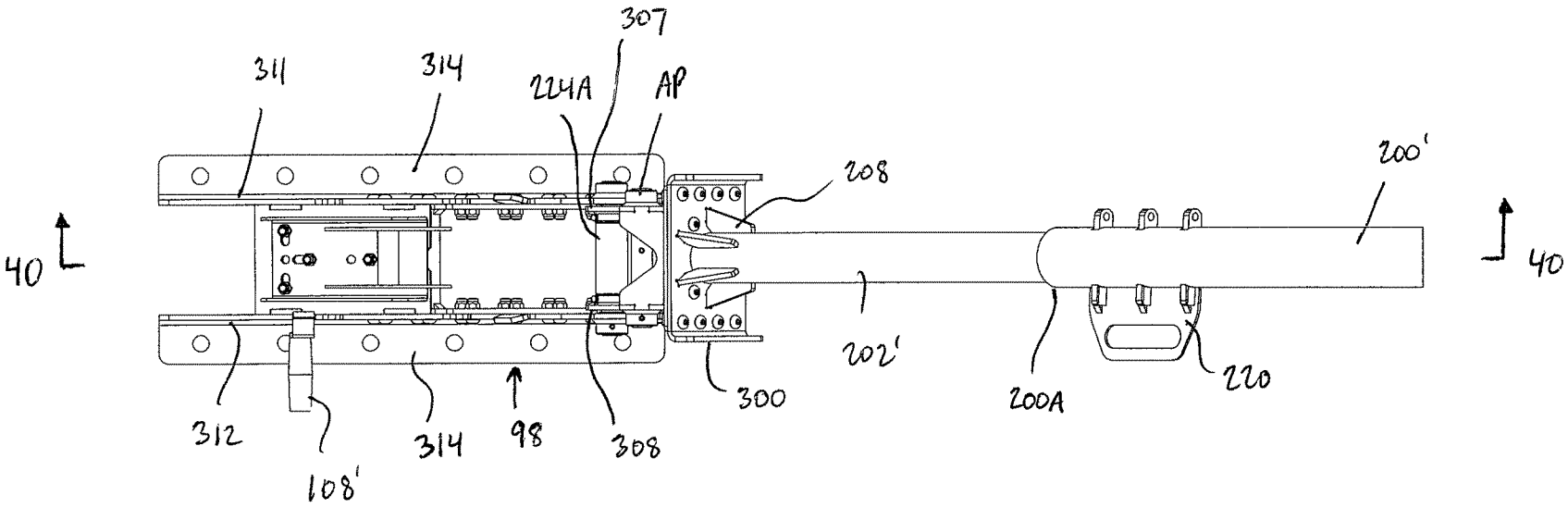
FIG. 39 is an enlarged top plan view of the tower in FIG. 38 showing a lower end of the tensioning system where some components are omitted for clarity of illustration.
Figure 40:
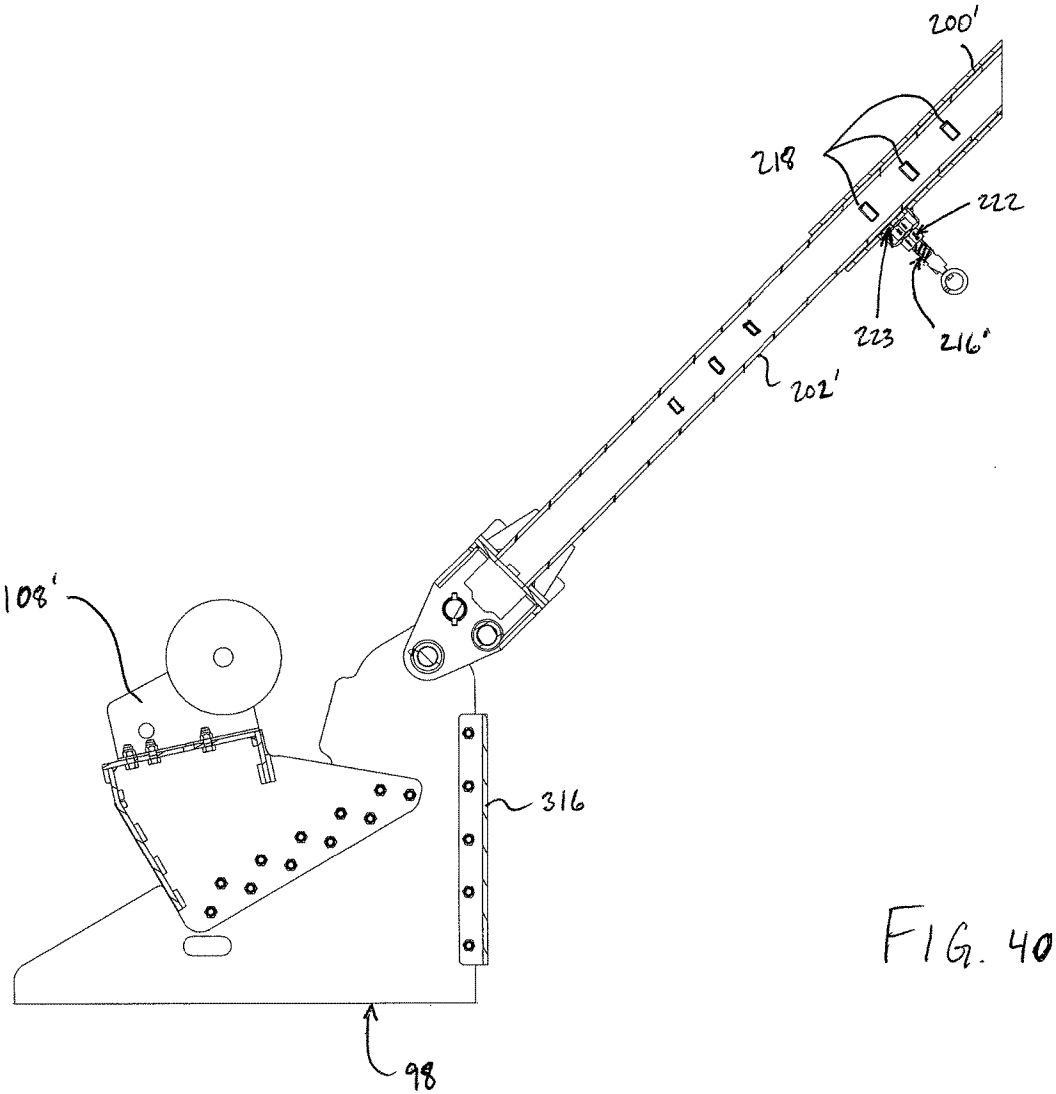
FIG. 40 is a cross-sectional view along line 40-40 in FIG. 39.
Figure 41:
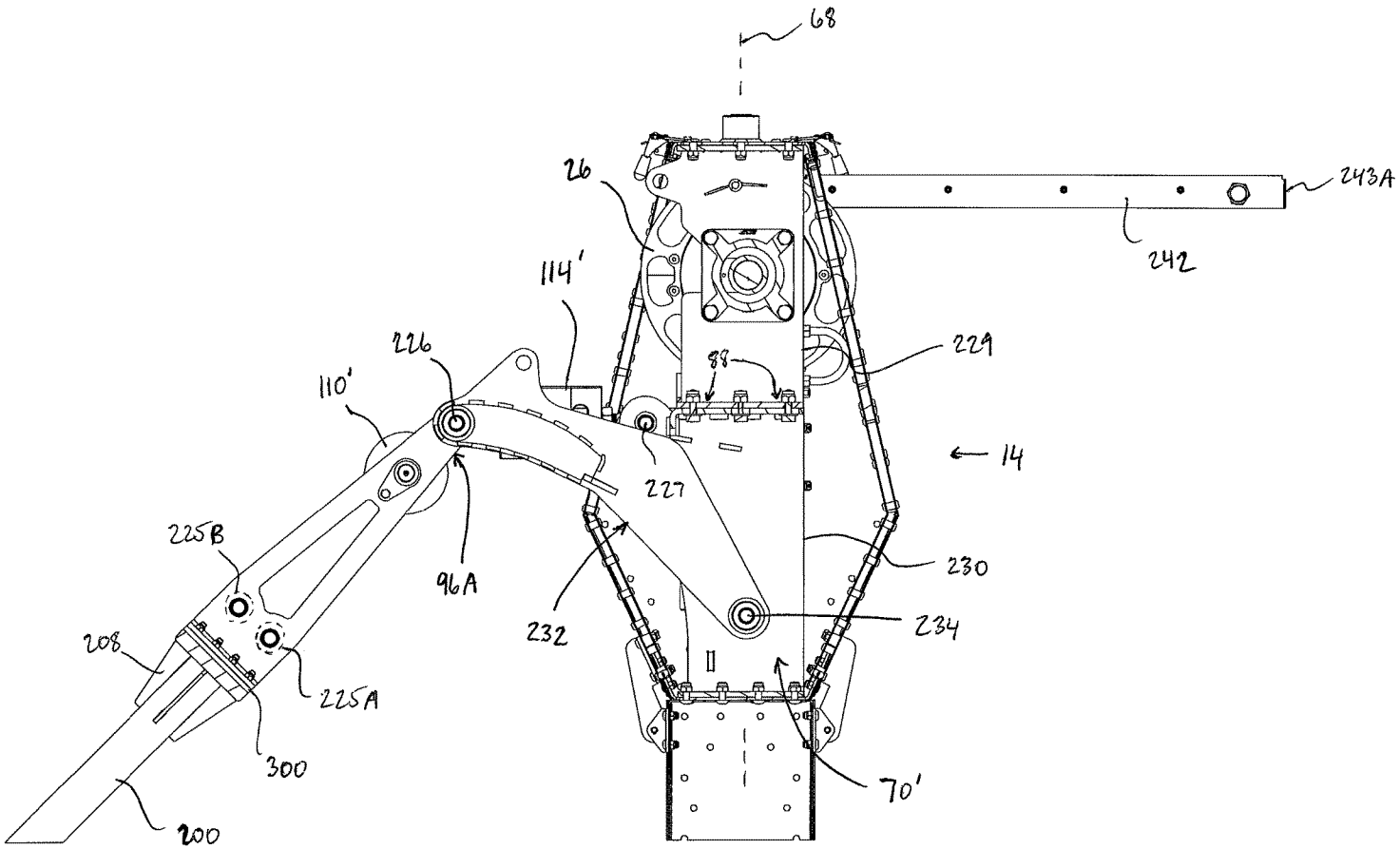
FIG. 41 is an enlarged side elevational view of the tower in FIG. 31 showing an upper end of the tensioning system and tower with a portion of a tower housing and motor removed for clarity of illustration.
Figure 42:
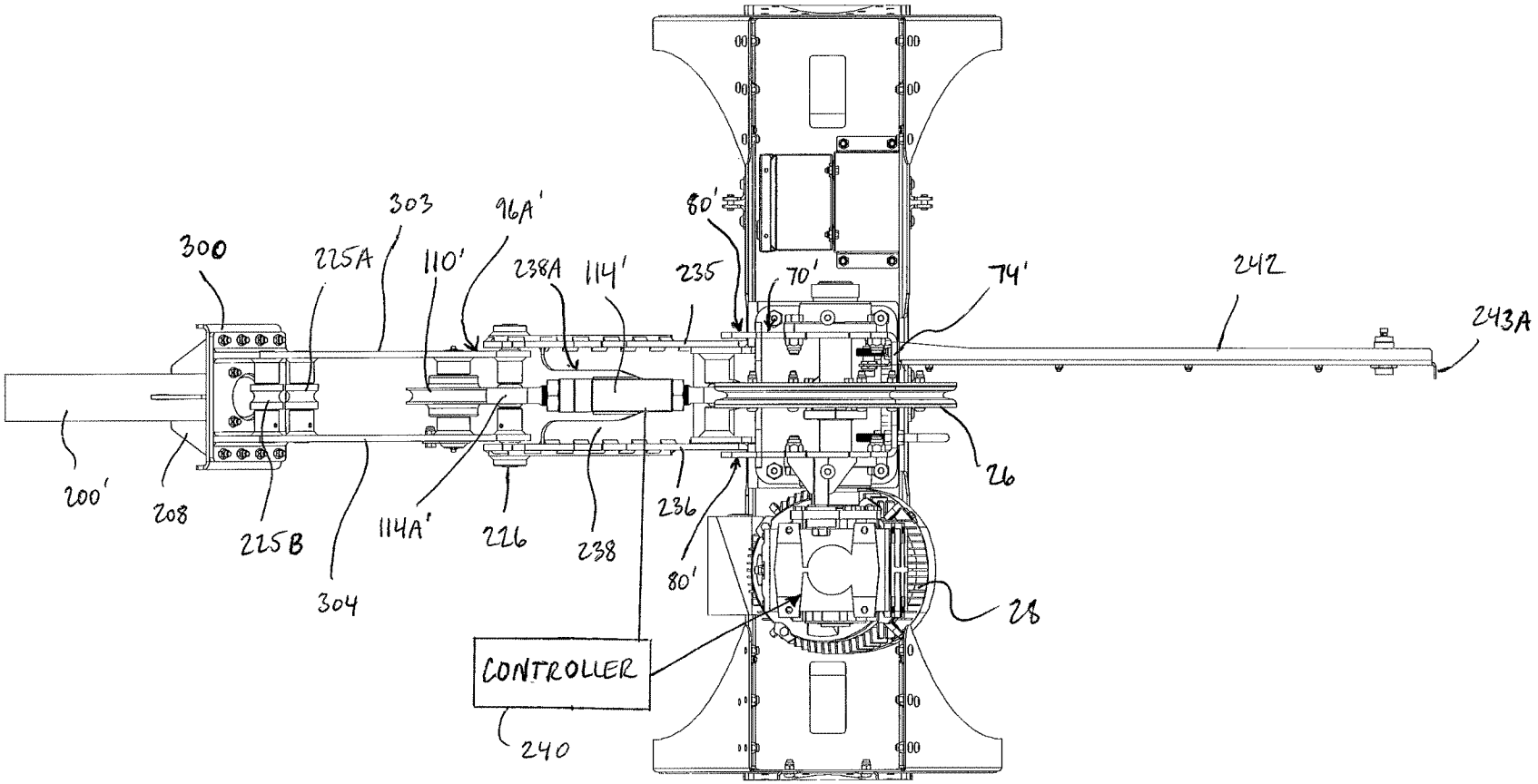
FIG. 42 is a top plan view of the first tower in FIG. 32 with a top portion of the tower housing removed for clarity of illustration.

The stopping aperture 210 is aligned with the finger 214 angularly of the rigid member axis so that when the finger passes over the stopping aperture, the aperture will catch the finger which will be forced therein by the biasing spring arrangement 216 as more clearly shown in FIG. 34.

The stopping aperture 210 is elongated longitudinally of the inner tube 202 so as to be larger than a width of the finger measured in this same dimension, which is measured along the axis A of the rigid member. As such, the stopping aperture has a greater likelihood of catching the finger 214 when the outer channel and inner channel are moving away from one another at considerable speed relative to each other.

A series of such stopping apertures may be provided at longitudinally spaced positions for redundancy.

A similar safety device is provided for the tension bar 96" used in conjunction with the tower not having a motor (termed "deflection tower" hereinafter for convenience of reference). This tension bar 96" has an inner channel 202' with a plurality of setting apertures 218 extending diametrically through the inner channel that function similarly to the holes indicated at 104. The setting apertures 218 arranged in groups 218A of three spaced along the length of the inner tube, as better illustrated in FIG. 38 where these setting apertures 218 are shown schematically. Typically, each grouping 218A is spaced from the next by a larger distance than the spacing distance between each pair of adjacent apertures of a respective grouping, in which the apertures are uniformly spaced from one another. The setting apertures 218 are arranged in a single row longitudinally of one another. The outer channel 200' has a grouping of corresponding apertures 219 extending diametrically through the outer channel in angular alignment with the setting apertures 218 relative to the axis A of the tension bar. A multi-pronged pin 220 with three prongs in the illustrated arrangement is provided for passing through the apertures 219 of the outer channel when these are properly registered with the setting apertures 218 of the inner channel, that is with one of the groupings 218A of the setting apertures.

By grouping a plurality of apertures into smaller sets of the apertures each containing at least two thereof, gradual wear of the apertures where the aperture deform (e.g. to grow in a certain direction) under the tension exerted on the tension bar when the pin 220 is passed through the apertures may be limited to affecting only the spacing between each pair of apertures as measured within the respective grouping. That is, the wear may be localized to the respective grouping of the apertures only because each grouping of the setting apertures defines a predetermined combination of the apertures which will always cooperate together with the pin 220. Therefore, the multi-pronged pin which has fixed spacing between its prongs is likely to remain insertable and usable even though the setting apertures of a respective grouping may deform with use. This may not be true for long-term use of a multi-pronged pin when such a pin is used with setting apertures all of which are uniformly spaced along the length of the inner tube such that they are not arranged into groupings, since the majority of the setting apertures may be used in at least two combinations with other such apertures.

The projecting element of tension bar 96" comprises a spring-biased pin 222 supported on the outer channel 200'. The pin 222 is oriented transversely of the axis A of the tension bar such that the pin is movable linearly in a radial plane of the outer channel. The pin which is carried at the outer surface of the outer tube 200' passes through an opening 223 in the outer channel and operates in a manner similar to the pivotal finger 214. A stopping aperture 210' (shown schematically in FIG. 38 together with an upper end of the inner channel 202' which is inside the outer channel) similar to that of tension bar 96' is provided for catching the biased pin 222 in the event that something causes the tower to move in a toppling manner before the tensioning length is fixed. A conventional spring arrangement 216' including a compression spring (schematically shown) is provided for biasing the pin towards the axis of the tension bar as described in this paragraph.

It will be appreciated that in the illustrated arrangement the motor tower and the deflection tower are supported by slightly different forms of the tension bar such that cost of the towing system may be minimized. The deflection tower is typically the first to be setup including setting its tensioning length (before the motor tower) and as such is used to establish tension in the running cable which is generally in the range of the desired tension. Thus, a pin-and-holes system to fix the tensioning length may be employed on the deflection tower with the motor tower having the clamp 204 arrangement which is capable of more finely tuning the tensioning length on the motor tower so as to achieve the desired tension value in the running cable. In other arrangements, for example where there are other factors outweighing that to minimize cost of the towing system, the tension bar used with the deflection tower may be of the same form as that which is used with the motor tower.

FIGS. 31 through 42 more clearly illustrate a structure of the tension bars 96', 96" and the mounting portion 98 of the illustrated second arrangement.

The main portion of the 100' includes the outer channel 200 which terminates at its upper end with a flange piece 300 oriented so as to lie in a radial plane of the outer channel 200. The flange piece is generally rectangular, for example square, in shape and is braced against the outer surface of the outer channel by gusset plates 208 in a similar fashion as those expressly indicated in cooperation with the flange 206.

A pair of parallel plates 303 and 304 are coupled to the flange piece 300 and extend outwardly along the tension bar axis away from the outer channel. The parallel plates 303, 304 are supported in spaced relation such that the tensioning guide pulleys can be rotatably carried therebetween. The tip of these plates 303, 304 locate a pivotal connection point between the tension bar and the tower, which will be described in more detail later. The plates 303, 304 may be sized sufficiently long, as measured along the axis A of the tension bar, such that the guide pulleys are sufficiently spaced apart from one another for properly guiding the tensioning cable 106.

At the lower end of the tension bar 96', 96", the inner channel 202 terminates at its lower end with the flange piece 300 with the gusset plates 208 bracing same, similarly to that at the upper end of the tension bar. A pair of parallel plates 307 and 308 extend outwardly along the tension bar axis away from the inner channel in spaced relation to one another such that lower tensioning guide pulley surfaces are rotatably supportable therebetween.

Pin 224A bridges between the parallel plates 307, 308 and forms the pivotal connection between of the tension bar at its lower end 96B with the mounting portion 98. The mounting portion is formed by a pair of upstanding plates 311 and 312 with bottom flanges 314 for securing the mounting portion to the respective support surface. The upstanding plates 311, 312 support the winch, and there is provided a cross member plate 316 extending between to reinforce the upstanding plates. The tension bar 96' is pivotally connected between the upstanding plates 311, 312.

FIGS. 31 through 42 also more clearly show the tensioning guide pulleys of the second arrangement that are used for guiding the tensioning cable inside the tension bar. This guide pulley arrangement is generally the same for both tension bars 96' and 96" regardless of the type of tower (i.e., motor or deflection) with which the tension bar is used.

The tensioning cable 106 (schematically shown) is secured at one end to a drum 108A of the winch 108. The continuous length of the cable 106 is then guided from the winch over pulley surface carried at pin 224A which pivotally connects the tension bar at its lower end 96B to the mounting portion 98. After pin 224A, the cable is further guided over pulley surface indicated at 224B after which the cable enters upwardly into the tension bar 96'. These pulley surfaces at 224A and 224B cooperate to guide the tensioning cable at the lower end of the tension bar such that the lower tensioning guide pulley 112, as referenced relative to the first arrangement of the towing system, may be interpreted as a series of cooperating pulleys.

The cable 106 extends parallel to the tension bar's axis A from the lower end 96 to the upper end 96A thereof and in a manner such that the tensioning cable is angularly offset from the stopping aperture 210 so as to provide clearance for the projecting element 214 in the event the projecting element is caught in the stopping aperture and avoid interference with the projecting element in this event.

The cable 106 then passes over a lower one 225A of a pair of intermediate guide pulleys (schematically shown) disposed closer to an open upper end 200B of outer channel 200 than to pin 226 which defines the pivotal connection point of the tension bar with the tower. Furthermore, the cable 106 passes about the upper one of the tensioning guide pulleys 110' and back downwardly over an upper one 225B of the pair of intermediate guide pulleys into the tension bar where the cable completes its loop and is anchored at AP at the lower end 96B' of the tension bar.

Moreover, the tensioning cable 106 is thus substantially covered by the channels 200, 202 forming the tension bar 96' such that these channels house the tensioning cable which is received therein. As such, operators and users of the towing system may be protected in the event that the tensioning cable 106 breaks as a majority of the length of the cable 106 is received in the tension bar and is thus unexposed to external surroundings in the area of the tower and tension bar where operators, users, or other individuals may be present. A relatively small portion is exposed adjacent the upper end 96A' where the cable 106 passes over upper guide pulley 110' and lower ends of the tension bar, such that this small portion may not present significant danger to individuals near the tower in the event the tensioning cable 106 breaks.

It will be appreciated that the tensioning guide pulleys in the second arrangement are supported on the tension bar at locations externally of the outer and inner tubular channels 200, 202.

Thus, during setup of the respective tower, the tensioning cable 106 is wound in about the drum 108A or fed out therefrom with length setting arrangement of the tension bar, comprising either one of the clamp 204 or the pin-and-hole configuration, being loosened such that the main portion and extendable portion are free to move relative to one another along the axis A of the tension bar. Once the desired tension in the running cable is achieved by adjusting the respective tower (measurement or determination of this tension value being achieved using the tension monitoring system), the length setting arrangement is operated so as to fix the tensioning length L of the tension bar, and then the tensioning cable is loosened so that the tension initially in the tensioning cable is carried by the tension bar.

In addition to the forgoing, the second arrangement includes a load cell 114', such as that of the strain gauge variety, forming the tension measuring device in this arrangement of the towing system. The load cell 114' is supported in horizontal orientation at a location in close proximity to the pulley 26 so as to provide accurate values of the running cable's tension. As such, the load cell is disposed at an upper end 96A of the tension bar with one end 114A' pivotally connected to the tension bar at pin 226 and another end 114B' of the load cell pivotally connected to the pulley support structure 22' at pin 227 at the convex portion 80' of segmented support brackets 70'. In the illustrated second arrangement, the support brackets 70' are segmented into upper and lower sections 229 and 230 with the lower section 230 being coupled in fixed relation within the housing 14 and the upper section 229 being pivotal on the lower section about the central upright axis 68 for adjusting the radial plane of the pulley using guide slots like those indicated at 88 formed in at least one of the upper and lower sections for setting the radial plane of the pulley in a particular alignment. As such, the tension bar and load cell are attached to the lower section 230 which is stationary such that the load cell is disposed just below the pulley 26 and at a top of the tension bar 96'.

With the load cell 114' bridging between the tower 12' and the tension bar 96', a separate connecting member 232 forming an arcuate neck is provided. The neck is pivotally connected at the tension bar at a common location with the load cell 114', that is at pin 226, and a different location at the tower than the load cell. That is, the neck 232 is pivotally connected to the tower at a location defined by pin 234 which is lower and forward of pin 227 (that is, forward here meaning further away from the tension bar 96'). In this configuration, the neck is movable relative to both the tension bar 96' and the tower 12' as the tensioning length L is changed thereby modifying the angle of the upstanding longitudinal axis of the tower 12' to the skiing surface. Furthermore, in this configuration the load cell 114' tends to maintain a prescribed horizontal orientation for a plurality of orientations of the tension bar and the tower in order to provide accurate values of tension as described in the previous paragraph even as the tension bar and tower are moved through their respective ranges of possible orientations for producing the desired tension in the running cable. In the illustrated arrangement, the horizontal orientation of the load cell 114' is defined by alignment of the ends of the load cell at pins 226 and 227 in a horizontal plane.

The neck 232 comprises a pair of parallel arcuate plates 235, 236 which are joined at their ends by pins 226 and 234 and intermediate their ends by bracing plate 238 spanning transversely therebetween at a location closer to the upper end of the neck, which is where the load cell and tension bar are joined, than the lower end where the neck is pivotally carried at the support brackets 70'. The bracing plate 238 comprises a cut-out 238A having an open end facing the tension bar for accommodating the load cell in an area between the parallel arcuate plates 235, 236 over a range of orientations of the tower and tensioning system.

The parallel arcuate plates are shaped so as to follow an arcuate path curving forwardly towards the tower and downwardly, from pin 226 at the tension bar to pin 234 at the tower. Furthermore, by the pivotal motion afforded by both pins 226 and 234, the neck follows such an arcuate path extending forwardly then downwardly from the tension bar to the tower for a plurality of orientations of the tension bar and tower.

In the illustrated second arrangement, the deflection tower comprises a spacer member 239 (schematically illustrated), such as a rigid rod, in lieu of the load cell that is pivotally connected between pins 226 and 227 so as to maintain a fixed distance between these two points defined by pins 226, 227. The spacer member is thus adapted for pivotal connection at its ends, such as by carrying an opening at each end, such that a pin can be received therethrough. As such, the spacer member 239 generally has similar shape to the load cell 114' but lacks the measurement capabilities thereof.

The load cell is operatively coupled, such as by electrical wires, to a programmable logic controller shown schematically at 240 which outputs the tension value of the running cable. The programmable logic controller 240 is operatively coupled, such as by electrical wires, to the motor 28 so as to control power to the motor. Thus, as described above, the motor can be shut off in the event that the tension value exceeds an acceptable safe threshold for the running cable so as to prevent the running cable from breaking.

The programmable logic controller 240 is also operable to monitor a position of the towing element 35 along the running cable and monitor the tension in the running cable. Furthermore, a stop arm 242 is provided extending from the front bracket portion 74'of the upper section 229 of the support brackets 70' so as to delimit a closest distance which the towing element can reach relative to the pulley 26 so as to resist collision therewith. The stop arm 242 is supported at a position spaced transversely to one side of the pulley, as more clearly shown in FIG. 42, and carries a flange 243A at its distal end that projects inwardly towards the running cable but to a position where the flange may not interfere with the running cable.

Additionally, the second arrangement includes a ladder 245 integrated into a side of the tower 12' which is usable for climbing to reach a top of the tower where the housing and other components are located. A plurality of handles which are vertically spaced apart at the side of the housing 14 are providing for manoeuvering from the ladder to one of the work platforms formed by the panels 116 as shown in FIG. 6.

It will be noted that in other arrangements of the towing system of the present invention, the towing system may include the tension bar of the tensioning system but without the tension measuring device.

Additionally, in other arrangements, the measuring device 114/114' may be implemented with a tensioning cable 106 free of a tension bar. That is, the tower may be held upright by an entirely exposed tensioning cable which is connected at its upper end to the tower, for example by a loop formed in the end of the tensioning cable and a pin passing through the loop, and at its lower end to a winch like that indicated at 108/108' that is mounted on the second portion of the support surfaces such that the tensioning cable is mounted in fixed location at its lower end to the respective support surface. Also, the arcuate neck may be arranged as described previously to facilitate a more rigid interconnection between the exposed tensioning cable and the tower. Therefore, as the tensioning cable is wound in about the drum of the winch or fed out therefrom so as to change the length of the tensioning cable spanning between the winch and the motor tower, with the running cable already having tension therein with the setup of the deflection tower so as to present a tension force opposing that of the tensioning cable, the motor tower thus pivots backwardly about its hinges towards the location of the lower end of the tensioning cable at the winch and the arcuate neck may pivot such that the load cell is maintained in horizontal orientation.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A towing system for towing a user on a support material, the towing system comprising:

a plurality of towers standing upwardly from a plurality of support surfaces, the plurality of towers being arranged relative to a skiing surface defined by the support material and each one of the plurality of towers having a base portion arranged for resting on a respective one of the plurality of support surfaces and an upper portion above the base portion that is arranged to be elevated relative to the skiing surface;

a pulley structure at or adjacent the upper portion of said each one of the towers, the pulley structure comprising: a shaft; and a pulley arranged for rotational motion about the shaft;

a motor on at least one of the plurality of towers that is operable to effect the rotational motion of the pulley over said at least one of the plurality of towers;

a cable passing along the pulleys of the plurality of towers so as to form a closed loop therebetween, the cable being arranged to span substantially over the skiing surface;

a towing element coupled to the cable and arranged to extend away therefrom over the skiing surface for towing the user along the skiing surface;

wherein the plurality of towers are supported on a first portion of the plurality of support surfaces;

a tensioning system coupled to at least one of the plurality of towers that is arranged to hold said at least one of the plurality of towers generally upright;

the tensioning system comprising a rigid member which is elongate and extends along an axis of the rigid member between the upper portion of said at least one of the plurality of towers and a respective one of a second portion of the plurality of support surfaces that is at a spaced distance from said at least one of the plurality of towers;

the rigid member being mounted at its lower end in a fixed location on the respective one of the second portion of the plurality of support surfaces and being connected at its upper end to the tower such that the axis of the rigid member is at an angle to the second portion of the plurality of support surfaces;

the rigid member being arranged to have tension therein along its axis at the angle with an adjustable length along said axis for tensioning the cable;

and the rigid member being substantially rigid when its adjustable length is set thus maintaining the lower end and upper end of the rigid member in fixed spaced relation along said axis when the tension in the rigid member is removed so as to resist movement of said at least one of the plurality of towers towards the respective one of the second portion of the plurality of support surfaces.

2. The towing system according to claim 1 wherein the rigid member comprises a plurality of telescoping elements which are elongate and arranged to be slidable relative to one another in a telescoping configuration for changing the length of the rigid member.

3. The towing system according to claim 1 wherein the rigid member comprises a main portion and an extendable portion each extending longitudinally along an axis of the rigid member with the extendable portion being movable relative to the main portion along the axis of the rigid member for changing the length of the rigid member.

4. The towing system according to claim 3 wherein the main portion forms an outer channel and the extendable portion forms an inner channel movable along the outer channel and wherein the main portion includes a clamp carried thereon for clamping to the extendable portion so as to hold the main portion and extendable portion in fixed relation to one another for fixing the length of the rigid member.

5. The towing system according to claim 4 wherein the extendable portion defines a flat surface along its length such that the clamp is usable at any location along said length of the inner channel.

6. The towing system according to claim 4 wherein the clamp includes visual indicators which are operable to illuminate a pre-specified colour when a predetermined clamping pressure is reached.

7. The towing system according to claim 3 wherein the main portion forms an outer channel and the extendable portion forms an inner channel movable along the outer channel and wherein the main portion includes a projecting element carried on the outer channel that is biased inwardly towards a center of the outer channel so as to be operable for engaging the extendable portion.

8. The towing system according to claim 7 wherein the extendable portion includes a stopping aperture which is aligned with the projecting element angularly of the rigid member axis with the extendable portion otherwise being substantially uninterrupted along its length.

9. The towing system according to claim 8 wherein the extendable portion includes a plurality of setting apertures which are aligned with apertures in the main portion angularly of the rigid member axis for receiving a pin when at least one of the setting apertures is registered with at least one aperture of the main portion, and wherein the setting apertures are offset angularly of the stopping aperture.

10. The towing system according to claim 1 wherein the tensioning system further comprises a tension monitoring system, the tension monitoring system including a measuring device arranged to measure tensile force in the rigid member for determining tension in the cable.

11. The towing system according to claim 10 wherein the measuring device is configured to generate an output signal when the tension in the cable exceeds a safe limit, the output signal being operable to turn off the motor.

12. The towing system according to claim 10 wherein the measuring device comprises a load cell at or adjacent an upper end of the rigid member that is supported in horizontal orientation between the upper portion of the respective tower and the rigid member.

13. The towing system according to claim 10 wherein the measuring device comprises a load cell which is located at or adjacent an upper end of the rigid member but spaced below the pulley.

14. The towing system according to claim 10 wherein the measuring device comprises a load cell connected between the tower at a location and the rigid member at its upper end such that there is provided a separate connecting member extending between the upper end of the rigid member and the respective tower at a different location thereon.

15. The towing system according to claim 14 wherein the load cell and the connecting member are attached to the rigid member at a common location.

16. The towing system according to claim 14 wherein the connecting member is movable by swiveling movement relative to the rigid member and the tower with the different location being lower than a location of connection at the upper end of rigid member such that the load cell is maintained at a prescribed orientation.

17. The towing system according to claim 16 wherein the different location of the connecting member is forward of the location of the load cell on the tower so as to be further away from the rigid member.

18. The towing system according to claim 14 wherein the connecting member follows an arcuate path extending forwardly then downwardly from the rigid member to the tower.

19. A towing system for towing a user on a support material, the towing system comprising:

a plurality of towers standing upwardly from a plurality of support surfaces, the plurality of towers being arranged relative to a skiing surface defined by the support material and each one of the plurality of towers having a base portion arranged for resting on a respective one of the plurality of support surfaces and an upper portion above the base portion that is arranged to be elevated relative to the skiing surface;

a pulley structure at or adjacent the upper portion of said each one of the towers, the pulley structure comprising:
a shaft; and
a pulley arranged for rotational motion about the shaft;

a motor on at least one of the plurality of towers that is operable to effect the rotational motion of the pulley over said at least one of the plurality of towers;

a cable passing along the pulleys of the plurality of towers so as to form a closed loop therebetween, the cable being arranged to span substantially over the skiing surface;

a towing element coupled to the cable and arranged to extend away therefrom over the skiing surface for towing the user along the skiing surface;

wherein the plurality of towers are supported on a first portion of the plurality of support surfaces;

a tensioning system coupled to at least one of the plurality of towers that is arranged to hold said at least one of the plurality of towers generally upright;

the tensioning system comprising an elongate tensioned member extending along an axis of the member between the upper portion of said at least one of the plurality of towers and a respective one of a second portion of the plurality of support surfaces that is at a spaced distance from said at least one of the plurality of towers;

the tensioned member being mounted at its lower end in a fixed location on the respective one of the second portion of the plurality of support surfaces and being connected at its upper end to the tower such that the axis of the tensioned member is at an angle to the second portion of the plurality of support surfaces;

the tensioned member having tension therein along its axis at the angle with an adjustable length along said axis for tensioning the cable;

and the tensioning system including a measuring device bridging the upper end of the tensioned member and the tower so as to be arranged to measure tensile force in the tensioned member for determining tension in the cable.

* * * * *